US012264471B2

(12) United States Patent
Sollami

(10) Patent No.: US 12,264,471 B2
(45) Date of Patent: Apr. 1, 2025

(54) SYSTEMS AND METHODS OF CONTROLLING CLOSURE OF A TOILET SEAT AND VENTILATION OF A TOILET BOWL

(71) Applicant: Jimmie L. Sollami, Herrin, IL (US)

(72) Inventor: Jimmie L. Sollami, Herrin, IL (US)

(73) Assignee: JonEvac Corporation, Houston, TX (US)

( * ) Notice: Subject to any disclaimer, the term of this patent is extended or adjusted under 35 U.S.C. 154(b) by 184 days.

(21) Appl. No.: 18/127,827

(22) Filed: Mar. 29, 2023

(65) Prior Publication Data

US 2024/0328137 A1 Oct. 3, 2024

(51) Int. Cl.
*E03D 9/052* (2006.01)
*A47K 13/12* (2006.01)

(52) U.S. Cl.
CPC ..... *E03D 9/052* (2013.01); *A47K 13/12* (2013.01)

(58) Field of Classification Search
CPC ..... E03D 9/052; E03D 9/05; A47K 13/12; A47K 13/307
USPC ..... 4/348, 347, 420, 300, 209, 306; 454/341
See application file for complete search history.

(56) References Cited

U.S. PATENT DOCUMENTS

| | | | |
|---|---|---|---|
| 629,462 | A | 11/1899 | Old |
| 988,273 | A | 3/1911 | Levenhagen |
| 1,972,076 | A | 8/1933 | Cross |
| 2,072,780 | A | 1/1936 | Turner |
| 2,099,875 | A | 4/1937 | Weaver |
| 2,240,094 | A | 5/1939 | Foreman |
| 2,286,555 | A | 5/1942 | Long |
| 3,192,539 | A | 7/1965 | Martz |
| 3,416,167 | A | 12/1968 | Klemme |
| 3,491,382 | A | 1/1970 | Poister |
| 3,733,619 | A | 5/1973 | Smith |
| 3,763,505 | A | 10/1973 | Zimmerman |
| 3,781,923 | A | 1/1974 | Maisch et al. |
| 3,902,203 | A | 9/1975 | Poister et al. |
| 3,913,150 | A | 10/1975 | Poister et al. |
| 3,916,459 | A | 11/1975 | Ivancevic |
| 3,938,201 | A | 2/1976 | McGrew |
| 3,999,225 | A | 12/1976 | Ables |
| 4,007,498 | A | 2/1977 | Pearson |
| 4,011,608 | A | 3/1977 | Pearson |
| 4,031,574 | A | 6/1977 | Werner |
| 4,044,408 | A | 8/1977 | Pearson |

(Continued)

FOREIGN PATENT DOCUMENTS

| | | | |
|---|---|---|---|
| EP | 1621691 A2 * | 2/2006 | ..... A47K 13/307 |
| EP | 3145380 B1 * | 11/2019 | ..... A47K 13/307 |

(Continued)

*Primary Examiner* — Lori L Baker
(74) *Attorney, Agent, or Firm* — Pitts Lake, LLC

(57) ABSTRACT

A toilet seat hinge assembly for a toilet bowl, including a toilet seat configured with a hinge receptor proximate an axis about which toilet seat rotates when moving between open and closed states, a hinge block with a hinge member extending therefrom and configured to be received by the hinge receptor of the toilet seat so as to rotatably couple the toilet seat to the hinge block, at least one resistance member disposed between the toilet seat hinge receptor and the hinge block to resistively inhibit the toilet seat from pivoting when the toilet seat is raised or lowered relative to the toilet bowl.

20 Claims, 19 Drawing Sheets

(56) References Cited

U.S. PATENT DOCUMENTS 4,085,470 A 4/1978 Roberts
4,094,023 A 6/1978 Smith
4,117,559 A 10/1978 Boyle
4,125,906 A 11/1978 Weiland
4,153,956 A 5/1979 Fischer, Sr. et al.
4,175,293 A 11/1979 Stephens et al.
4,232,406 A 11/1980 Beeghly et al.
4,251,888 A 2/1981 Turner
4,272,527 A * 6/1981 Belkevich ..... A61K 8/97 424/762
4,365,361 A 12/1982 Sanstorm
4,556,999 A 12/1985 Lindley
4,617,687 A 10/1986 Wadsworth
4,701,966 A 10/1987 Schafer
4,726,078 A 2/1988 Carballo et al.
4,876,748 A 10/1989 Chun
4,882,790 A 11/1989 Ricard
4,893,359 A 1/1990 Vu et al.
4,984,310 A 1/1991 Casale
5,345,617 A 9/1994 Jahner et al.
5,539,937 A 6/1996 Barefoot
5,727,262 A 3/1998 Littlejohn
6,167,576 B1 * 1/2001 Sollami ..... A47K 13/307 4/217
6,233,750 B1 5/2001 Donald et al.
6,298,500 B1 * 10/2001 Sollami ..... A47K 13/307 4/217
6,360,377 B2 * 3/2002 Sollami ..... E03D 9/05 4/213
6,588,025 B1 7/2003 Helmolt
6,678,900 B2 1/2004 Ware
6,760,928 B1 * 7/2004 Rodriguez ..... E03D 9/052 4/217
6,772,449 B1 * 8/2004 Wolfe ..... E03D 9/05 4/213
6,779,204 B1 8/2004 Ciotic
7,103,925 B2 * 9/2006 Toth ..... E03D 9/05 4/351
7,165,274 B1 * 1/2007 Vilhauer ..... E03D 9/052 4/213
7,337,476 B2 * 3/2008 Green ..... E03D 9/052 4/213
7,596,818 B2 * 10/2009 Sutton ..... E03D 9/05 4/213
7,797,766 B2 9/2010 Ellinger
7,895,682 B1 * 3/2011 De Nyse ..... E03D 9/052 4/213
7,987,527 B1 * 8/2011 Shumaker ..... E03D 9/052 4/213
8,973,174 B2 * 3/2015 Palazzola ..... E03D 9/052 4/216
9,307,878 B2 * 4/2016 Kosovac ..... E03D 9/05
9,481,990 B2 * 11/2016 Sollami ..... A47K 13/307
9,532,687 B2 * 1/2017 Sollami ..... E03D 9/05
9,877,623 B2 * 1/2018 Sollami ..... E03D 9/05
10,168,679 B2 * 1/2019 Tyson ..... A47K 13/307
10,357,654 B1 * 7/2019 Pilly ..... A61B 5/055
10,420,937 B2 * 9/2019 Pilly ..... A61B 5/24
10,787,801 B1 * 9/2020 Lovins ..... E03D 9/052
10,835,090 B2 * 11/2020 Payziev ..... E03D 9/05
10,975,557 B2 * 4/2021 Finkbeiner ..... E03D 9/052
11,186,370 B2 * 11/2021 Taguchi ..... B64D 11/02
11,828,054 B1 * 11/2023 Davoud ..... E03D 9/05
12,042,104 B2 * 7/2024 Hung ..... E03D 9/052
2001/0054195 A1 12/2001 Simpson
2006/0248634 A1 * 11/2006 Sollami ..... E03D 9/052 4/217
2014/0137317 A1 * 5/2014 Sollami ..... E03D 9/05 4/213
2016/0010318 A1 * 1/2016 Sollami ..... A47K 13/307 4/213
2016/0338556 A1 * 11/2016 Payziev ..... A47K 13/307

FOREIGN PATENT DOCUMENTS

FR 89-174852/24 4/1989
FR 2622228 A 4/1989
GB 2143872 A 2/1985

* cited by examiner

SYSTEMS AND METHODS OF CONTROLLING CLOSURE OF A TOILET SEAT AND VENTILATION OF A TOILET BOWL

FIELD OF INVENTION

The present general inventive concept relates to the field of toilet assemblies, and more particularly relates to systems and methods of controlling closure of a toilet seat and removing odors, bacteria, and/or particulate matter from air drawn from a toilet bowl.

BACKGROUND

The benefit of ventilating air from various areas and devices has long been recognized. Accordingly, many devices have been developed to provide such a function. For instance, U.S. Pat. No. 6,167,576, (hereinafter "the '576 Patent"), U.S. Pat. No. 6,298,500, (hereinafter "the '500 Patent"), and U.S. Pat. No. 9,877,623, (hereinafter "the '623 Patent"), describe various embodiments of a ventilated toilet seat assembly for evacuating noxious odors from within a toilet bowl. The inventions of the '576 Patent, the '500 Patent, and the '623 Patent are commonly owned with the present invention. It has been discovered that when the toilet seat is freely or variably released when the toilet seat is moved to the down or closed position, there is a risk that the toilet seat will slam against the toilet bowl under the unrestricted force of gravity causing unnecessary shock, wear, and tear on both the toilet seat and the toilet. Embodiments of the present general inventive concept provide a ventilated toilet seat that includes a resistance member that acts in cooperation with the toilet seat and the hinge block and that is adapted such that upon a user applying an external force to raise the toilet seat, the resistance member resistively holds the raised ventilated toilet seat with respect to the toilet and also does not freely release the toilet seat when external force is applied to lower the toilet seat to the down position.

SUMMARY

A ventilated toilet system is described herein that includes a housing having an inlet port and an exhaust port, said housing including a filter receptacle having a guide member interposing said inlet port and said exhaust port to mate with a mating portion of a filter unit, the mating portion including one or more protrusions extending from opposing surfaces of the filter unit to mate with the filter receptacle, such that an inlet side of the filter unit is secured a predetermined distance away from the inlet port. A conduit comprising a first end and a second end, in which the first end is securable adjacent to a toilet bowl and the second end is connected to the inlet port. A fan assembly is in fluid communication with the ventilated toilet bowl such that the filtration system defines an air flow channel to draw air from the toilet bowl through the conduit into the inlet port, through the filter unit, and through the exhaust port. The ventilated a toilet seat is configured with a manifold proximate an axis about which toilet seat rotates when moving between open and closed states. A hinge block with a sleeve extending therefrom and configured to be received by the manifold of the toilet seat so as to rotatably couple the toilet seat to the hinge block is also provided. This allows the ventilated toilet seat to be pivotally coupled to the toilet bowl by the toilet seat hinge block. Further, the sleeve engages with the manifold of the toilet seat and an exhaust portion so as to be in fluid communication with the air flow channel to deliver air from an underside of the ventilated toilet seat to the air flow channel such that the ventilated toilet seat includes an intake, referred to herein as the manifold which receives the said toilet seat hinge sleeve. The manifold is in fluid communication with the toilet bowl, whereby said fan assembly, when activated, draws air from said toilet bowl through said toilet seat hinge and into said air flow channel. At least one resistance member is disposed between the toilet seat manifold and the hinge block sleeve to resistively inhibit the toilet seat from pivoting when the toilet seat is raised or lowered relative to the toilet bowl. Further, a controller to selectively activate the fan assembly is also provided.

In one exemplary embodiment a filter unit is removably secured within the filter receptacle; and a filtration media is contained within an interior volume of the filter unit, in order to collect odors, bacteria, particulate matter, or any combination thereof when air passes through said filtration media. Further, the filtration media can be selected to trap and kill bacteria that enters the filter unit.

In a further exemplary embodiment of the ventilated toilet seat, the resistance member is defined by at least one spring washer. It will be recognized that a plurality of spring washers can either be stacked in series or in parallel.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
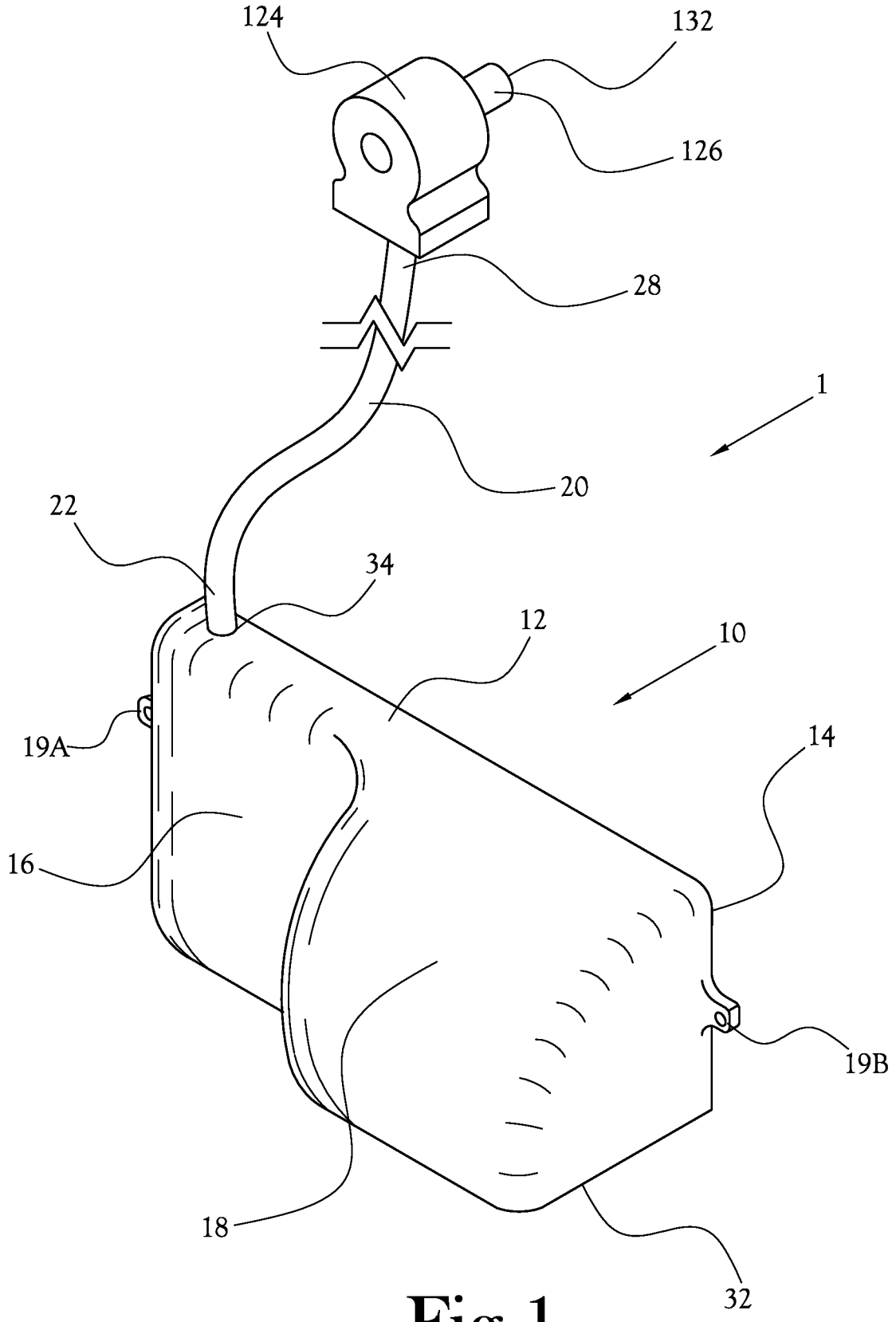
FIG. 1 illustrates a perspective view of an example embodiment of the present general inventive concept.

A toilet system for use with a ventilated toilet seat assembly incorporating various features of the present general inventive concept is illustrated generally at 1 in FIG. 1. The toilet/filtration system 1 is designed for filtering air drawn from a toilet 72 using a ventilated toilet seat 76, such as the ones described in detail in U.S. Pat. Nos. 6,167,576, 6,298,500, and 9,877,623, the contents of which are incorporated herein by reference in their entirety. The filtration system 1 further includes a housing 10 designed to be mounted on a wall behind the toilet 72 and under an associated tank 74, when provided, such that a substantial portion of the housing 10 is concealed from view. It will be noted that in commercial use, toilets 72 are often provided with a water supply from a remote location and a resident-type tank 74, as illustrated, is not associated with the toilet 72.

Figure 2:
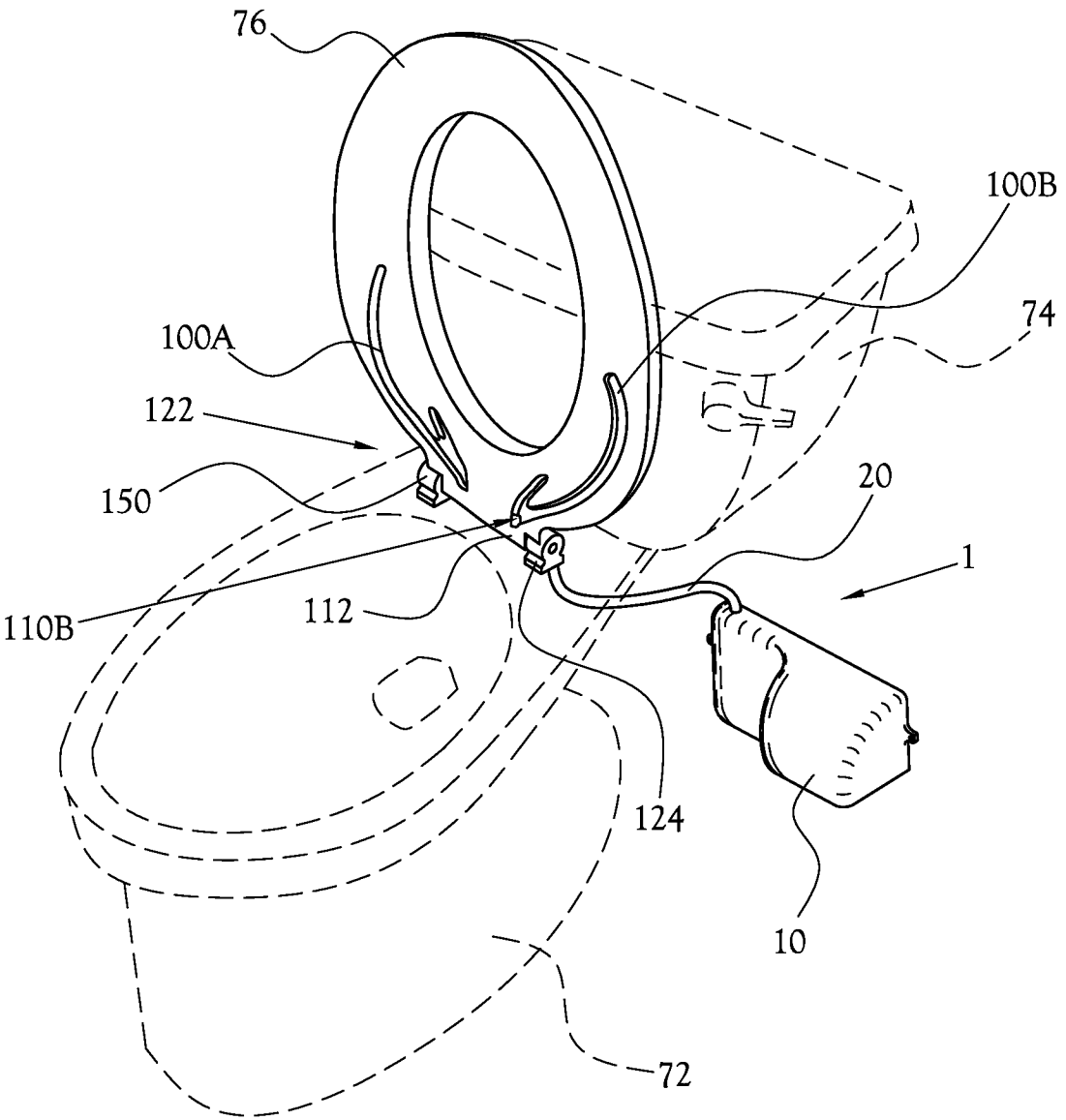
FIG. 2 illustrates a perspective view of an example embodiment of the present general inventive concept in fluid communication with a ventilated toilet seat.

As illustrated in FIG. 2, housing 10 may be configured to be mounted on a wall behind a toilet 72 and under the toilet tank 74 such that it is substantially concealed from view. Although illustrated as being disposed on the right-hand side of the toilet 72, it will be understood that the housing 10 of the present general inventive concept may be modified to be positioned behind either side of the toilet 72. At least one conduit 20 may be attached to the housing 10 to extend to the ventilated toilet seat 76. In the illustrated embodiment, one such conduit 20 is provided for drawing contaminated air from a discrete evacuation channel 100B defined by the toilet 72 or toilet seat 76. However, it will be understood that in environments wherein two evacuation channels are provided, two conduits or a "Y" shaped conduit may be used.

A front view of an example embodiment housing 10 is illustrated at FIG. 1. A front panel 12 having two depth segments is connected to a rear panel 14 and a bottom panel 32 to define an interior volume 17 within the housing 10 of the illustrated embodiment. Specifically, an exemplary embodiment includes a front panel 12 having a first end segment 16 with curved side and top portions to connect with the rear panel 14 and defines an interior volume when also connected to the bottom panel 32. The second end segment 18 has curved side and top portions to connect with the rear panel 14 and defines a larger interior volume, with respect to the volume defined by the first end segment 16, when also connected to the bottom panel 32. It will be understood that the present general inventive concept is not limited to the specific shape of the housing member discussed above.

In the illustrated embodiment, one conduit receptacle, or inlet port 34 is defined near the top of the first depth segment of the housing's front panel for receiving the proximal end 22 of the conduit 20. It will be understood that the inlet port may include two conduit receptacles 34 in situations wherein two conduits 20 are used.

Housing 10 defines an air flow channel comprising a first end 36 and a second end 38 separated by a filter receptacle 50. The first end 36 may have a first depth dimensioned to be received behind a conventional toilet 72. As illustrated and as described above, conduit receptacle 34 is disposed near the top of the front panel proximate the first end 36. By disposing the first end 36 of the housing 10 behind the toilet 72, with the conduit receptacle 34 defined therein, the conduit 20 is directly routed from underneath the toilet seat 76 to a point behind the toilet 72, under the tank 74, and above the housing 10, thereby concealing a substantial portion of the conduit 20. The second end 38 of housing 10, in the illustrated embodiment, defines a larger depth in order to better facilitate maintenance of the interior components of the housing 10, as further described below. It is possible that the depth of the second end 38 of the housing 10 be less than the dimension from the front of the tank 74 to the wall such that the housing 10 may remain substantially concealed behind the toilet. Further, the length of the housing 10 may be dimensioned to be substantially received under tank 74. Because these dimensions may be varied in accordance with sound engineering judgment, it will be understood that the present general inventive concept is not limited to these dimensions.

As illustrated, the front panel 12 may include extension members 19A, 19B on either side to accommodate installing the housing against a wall. In this embodiment, the housing 10 is mounted to a wall in a conventional fashion, such as with wall anchors. The selected mounting device will depend upon the application, for example, taking into consideration the need for security from theft or vandalism. However, it will be understood that the present general inventive concept is not intended to be limited by the specific type of conventional fastener chosen to mount the housing 10.

In some embodiments, a fitting or connector is provided to couple the proximal end of the conduit 20 to the housing 10. The fitting may be fabricated from a rigid material such as metal, stainless steel, and/or plastic and includes a means for coupling the conduit 20 to the housing 10. The housing 10 may contain a conduit receptacle 34 that includes a corresponding means for receiving the fitting such that the fitting is mechanically mated with the conduit receptacle 34 to create a substantially airtight engagement and ease of hose change or replacement. In other embodiments, conduit 20 can be slip fit or press fit into the housing 10. In some embodiments, a connector is provided that is selectively attachable to the housing 10, to the conduit 20, or both, thereby facilitating a substantially airtight engagement. In other embodiments, the connector may be integrally formed with the conduit 20 and may be selectively attachable to the housing's conduit receptacle 34, or vice versa, to facilitate a substantially airtight engagement. The receptacle may be an adapter 23 (which may be made from a rigid material (such as metal, stainless steel, plastic, etc.) for connecting with the conduit and extending into the housing. The adapter may be a threaded device for securing and/or sealing the conduit to the housing. It may be made of a rigid material such as steel or stainless steel and molded into the housing.

Referring to FIGS. 2-3, the distal end 28 of the conduit 20 is connected to the ventilated toilet seat 76 by a toilet seat hinge 124. As illustrated, a ventilated toilet seat 76 defines two outlets 110A and 110B between the evacuation channels 100A and 100B and a manifold 112. In this embodiment, a manifold 112 is defined by the ventilated toilet seat 76 and extends from the back thereof. The manifold 112 defines an opening 114, or intake, for rotatably receiving the inlet portion 126 of a toilet seat hinge 124. Opening 114 may be formed as a through opening communicating with the outlets 110A and 110B as illustrated in FIG. 3 to direct air flow to a single seat hinge 124 and conduit 20 leading to the filter housing 18. Another seat hinge 124 could be provided on the opposite side of hinge assembly 122 to communicate with outlet 110B to direct air flow from the outlet 110B to the filter housing independent of outlet 110A. For example, each outlet 110A, 110B may communicate with a respective seat hinge 124 on opposite sides of the hinge assembly 122 to direct air flow to a respective conduit 20. In this case the opening 114 could be formed as a pair of openings 114, (e.g., blind holes configured on opposite sides of assembly 122 and separated by a separator 115), each communicating with a respective outlet 110A, 110B and hinge 124-conduit 20 arrangement, thus providing a pair of conduits 20 extending to the filter housing 18, entering the filter housing 18 either next to each other or at different points on the filter housing 18, depending on design choice. In a further exemplary embodiment, illustrated in FIG. 3F, ventilated toilet seat 76 further includes two additional outlets 110C and 110D providing fluid communication between the toilet bowl and manifold 112.

It is also possible to direct a pair of conduits 20 to a Y-fitting and then connect a single conduit 20 to the filter housing. Various other arrangements could be chosen to connect one or more conduits to the various example filter housings illustrated herein, using one or more hinges 124. The present general inventive concept is not limited to any particular configuration or shape of components to direct air flow from the evacuation channels 100A, 100B to a filter housing of the present general inventive concept. For example, the one or more hinges may have one or more receptors on the end(s) of the hinge, or the hinge may be a tube-like structure with a lumen extending the length of the hinge.

The toilet seat hinge 124 is provided for mounting the ventilated toilet seat 76 to a conventional toilet 72. To this extent, the toilet seat hinge 124 defines a threaded exhaust post 128 for being received in an opening defined by the conventional toilet 72 for mounting a seat thereto. The toilet seat hinge 124 thus defines an internal conduit 130 having a sleeve 132, that defines an intake, on the inlet portion 126 thereof and an exhaust 134 at the distal end of the threaded exhaust post 128. The toilet seat hinge 124 further includes a sleeve 132 configured to be received by the ventilated toilet seat manifold 112. It will be understood that, in one embodiment, the sleeve 132 is secured within the toilet seat hinge 124 so as to prevent sleeve 132 from rotating relative to toilet seat hinge 124. In this regard, a roll pin 125 could be utilized to secure sleeve 132 within toilet seat hinge 124. Alternatively, a set screw could be utilized. It will also be appreciated that sleeve 132 could be secured to toilet seat hinge 124 by means of an adhesive. In one exemplary embodiment the interior diameter, ("ID") of manifold 112, and the outer diameter, ("OD"), of sleeve 132 are selected such that manifold 112 does not frictionally engage sleeve 132. In a further exemplary embodiment, there is a tighter tolerance between the ID of manifold 112 and the OD of sleeve 132 such that manifold 112 does frictionally engage sleeve 132.

Figure 3A:
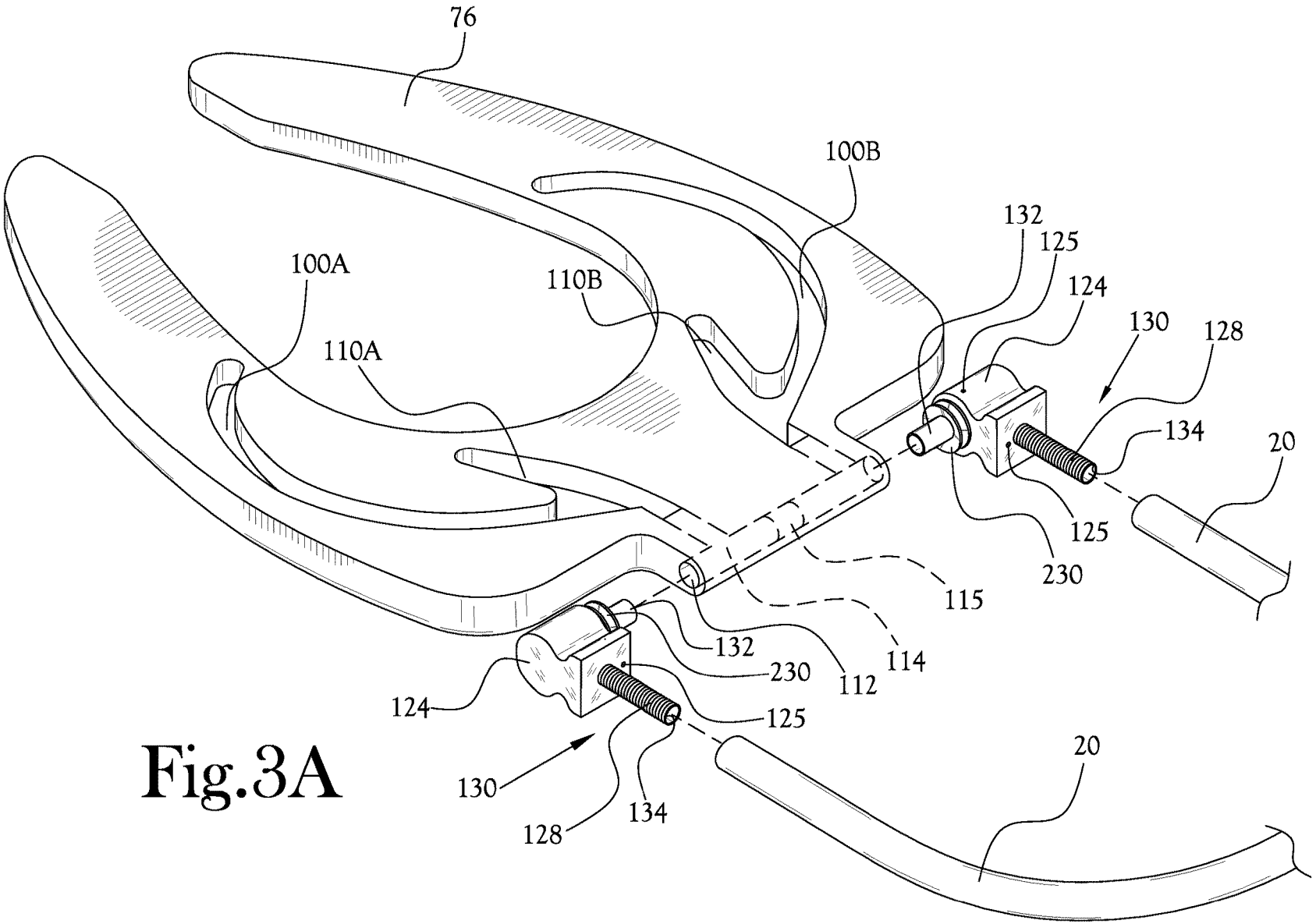
FIG. 3A illustrates an exploded view of an example embodiment of the toilet seat hinge and conduit engaging an inverted ventilated toilet seat.
Figure 3B:
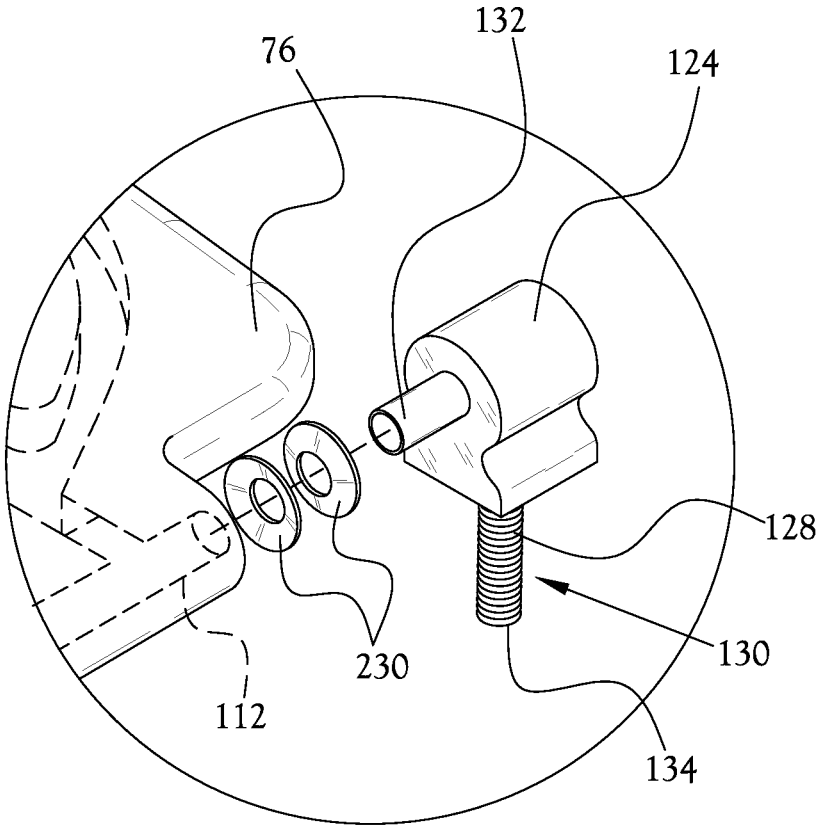
FIG. 3B is a close-up exploded view of one example embodiment of a toilet seat hinge and resistance member for a ventilated toilet seat according to the present general inventive concept.
Figure 3C:
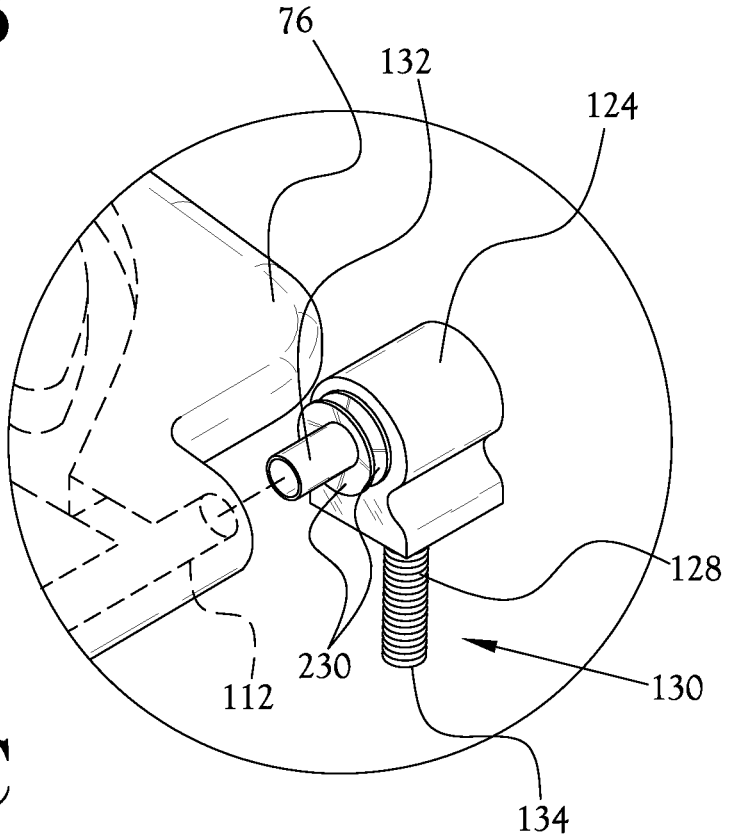
FIG. 3C illustrates close-up partially exploded perspective view of exemplary embodiment of the toilet seat hinge and conduit engaging a ventilated toilet seat illustrated in FIG. 3B.
Figure 3D:
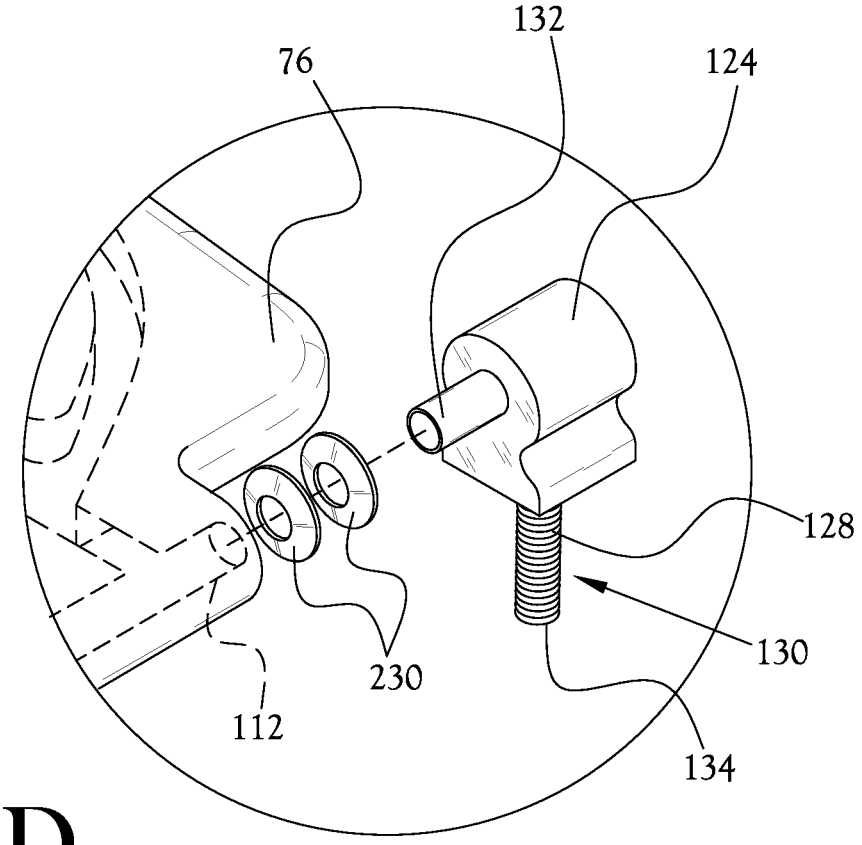
FIG. 3D is a close-up exploded view of one example embodiment of a toilet seat hinge and resistance member for a ventilated toilet seat according to the present general inventive concept.
Figure 3E:
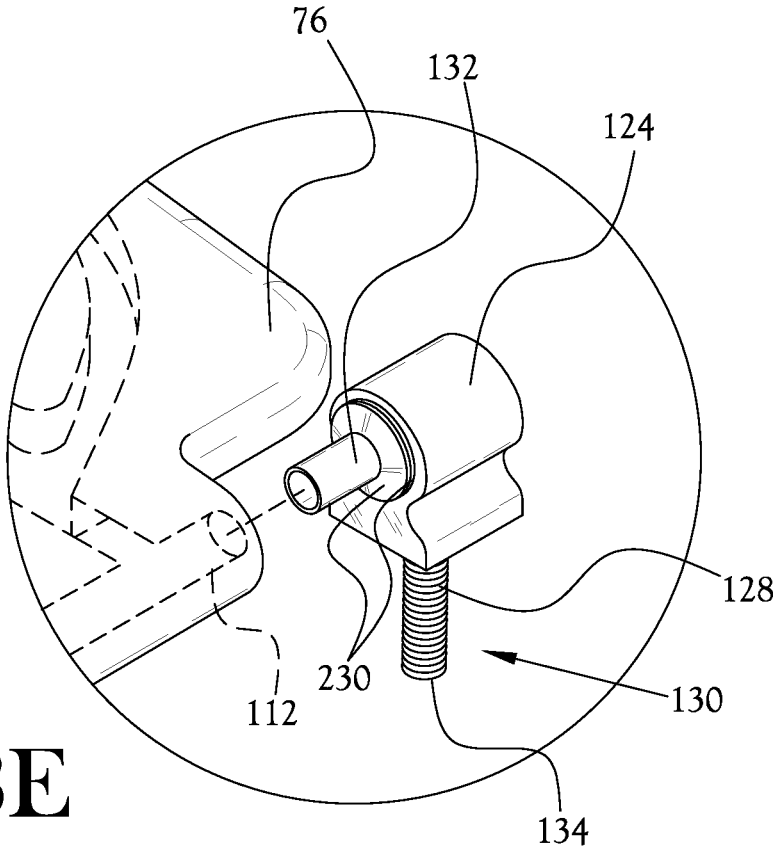
FIG. 3E illustrates close-up partially exploded perspective view of exemplary embodiment of the toilet seat hinge and conduit engaging a ventilated toilet seat illustrated in FIG. 3C.
Figure 3F:
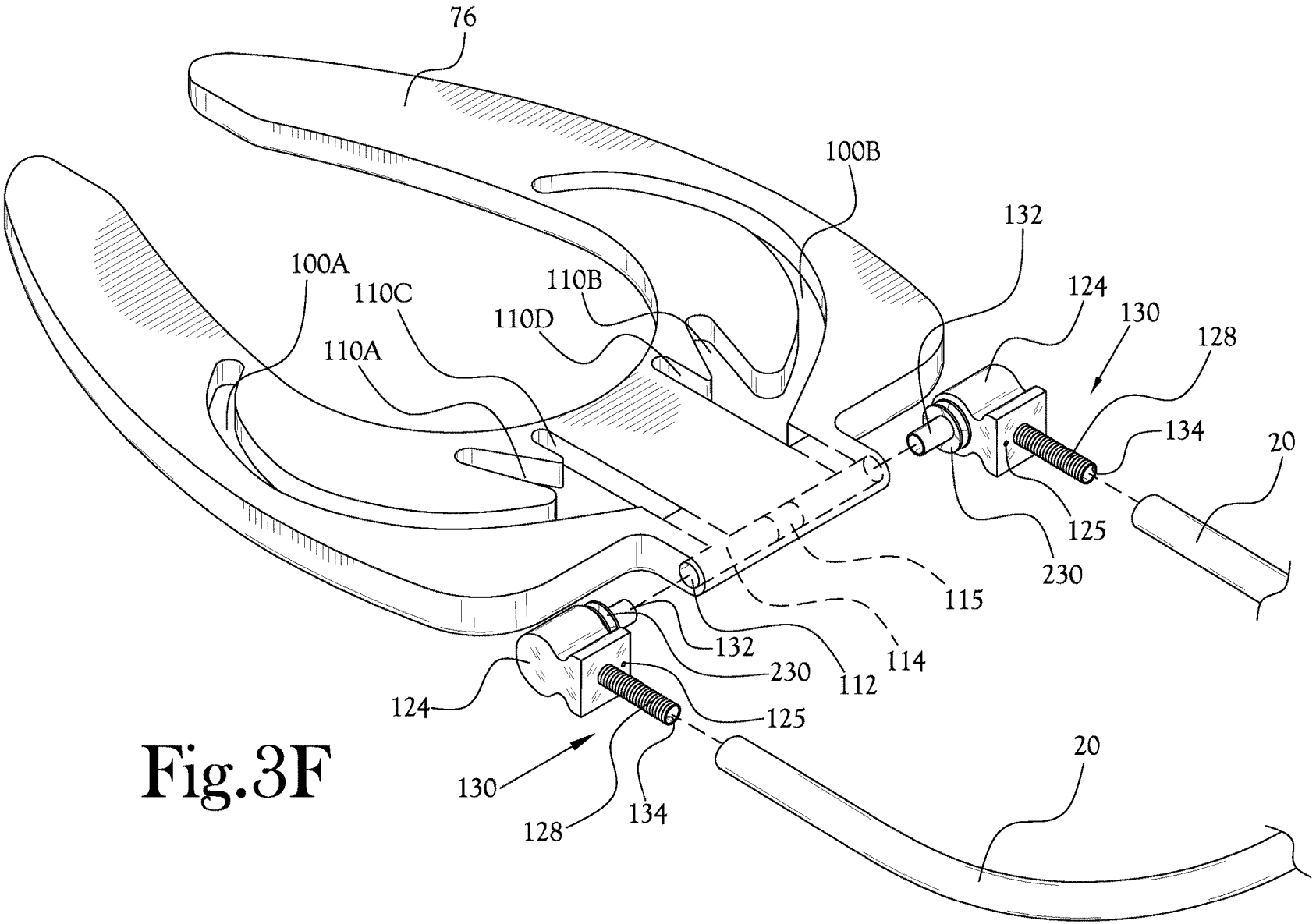
FIG. 3F illustrates an exploded view of an additional example embodiment of the toilet seat hinge and conduit engaging an inverted ventilated toilet seat.
Figure 3G:
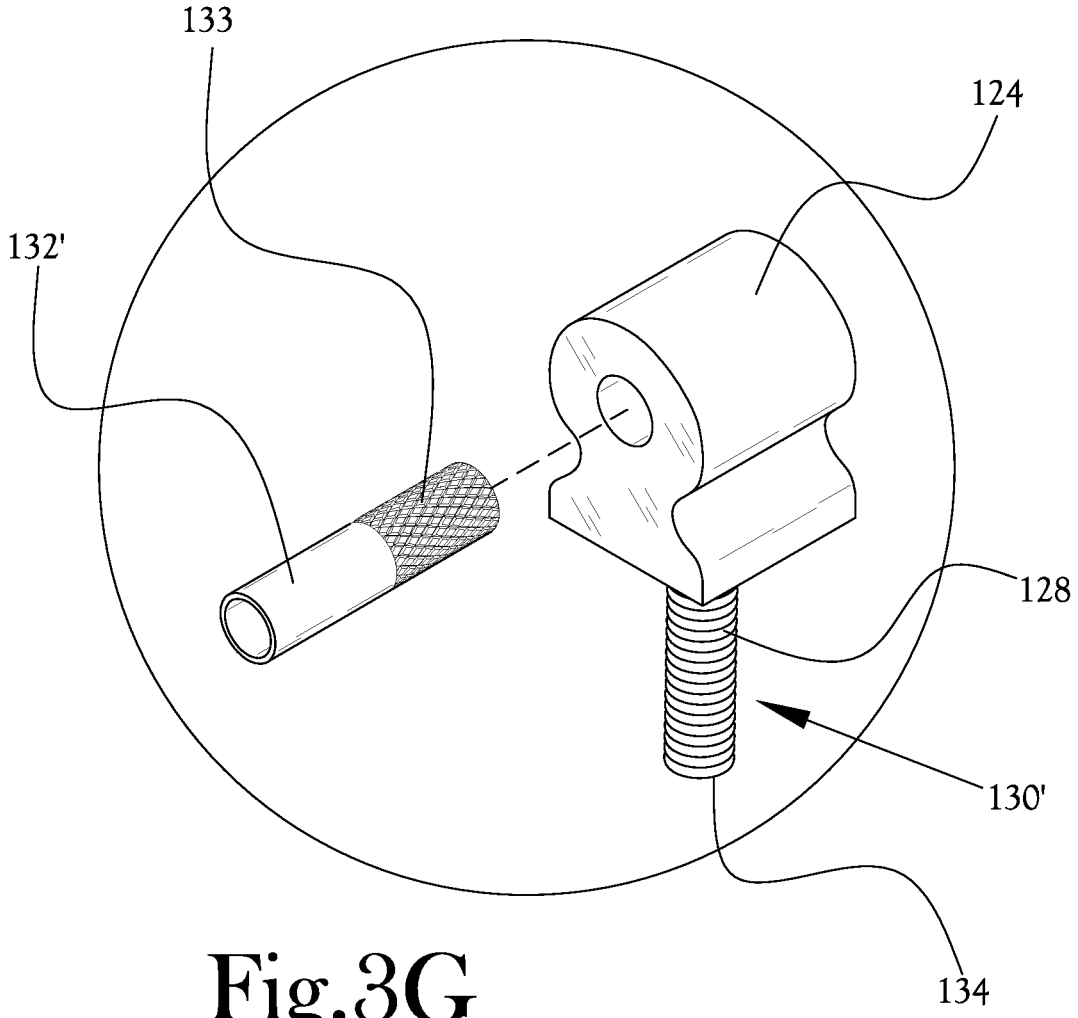
FIG. 3G illustrates an exploded view of an additional example embodiment of the toilet seat hinge and sleeve assembly.

In a further exemplary embodiment, illustrated in FIG. 3G, the sleeve 132' of internal conduit 130' is secured to the toilet seat hinge 124 by means of a knurled region 133. Knurled region 124 is received by toilet seat hinge 124. In this regard, as will be appreciated by those skilled in the art, the various components of the toilet seat can be manufactured from a resin or plastic compatible with an injection molding process. During the manufacturing process, when hinge block 124 is removed from an injection molding machine, an operator can insert sleeve 132' into hinge block 124 and as the resin or plastic material cools it will shrink into the grooves of knurled region 133. The resulting bond between the resin and knurled region 133 will create a stronger bond thus securing sleeve 132' in hinge block 124, thereby eliminating the need for a set screw, roll pin or an adhesive to prevent the sleeve 132' from rotating relative to hinge block 124. It would also be possible to provide a flat or other type of recess on the outer diameter of the sleeve such that when the plastic material cools it squeezes on the flat to securely lock the sleeve relative to the hinge block. While various means for securing the sleeve relative to the hinge block have been described herein, those skilled in the art will appreciate that various other means for preventing the sleeve from rotating relative to the hinge block could also be implemented using sound engineering judgement without departing from the scope of the present general inventive concept.

The exhaust post 128 receives the distal end 28 of the conduit 20. Thus, the internal conduit 130 is disposed to establish fluid communication between the evacuation channel 100A of the ventilated toilet seat 76, through the outlet 110A, through the through opening 114, through the internal conduit 130 of the toilet seat hinge 124, through the conduit 20, and into the interior volume 17 of the housing 10. In the currently illustrated embodiment, the hinge assembly 122 includes one toilet seat hinge 124 and one standard hinge 150 that cooperatively secure the ventilated toilet seat 76 to the toilet 72 and permit the ventilated toilet seat 76 to rotate around the standard hinge 150 and the inlet portion 126 of the toilet seat hinge 124. In an alternate embodiment where the ventilated toilet seat 76 contains two independent evacuation channel outlets (and a divided through opening), two ventilated toilet seat hinges 124 may comprise the hinge assembly 122.

Figure 4:
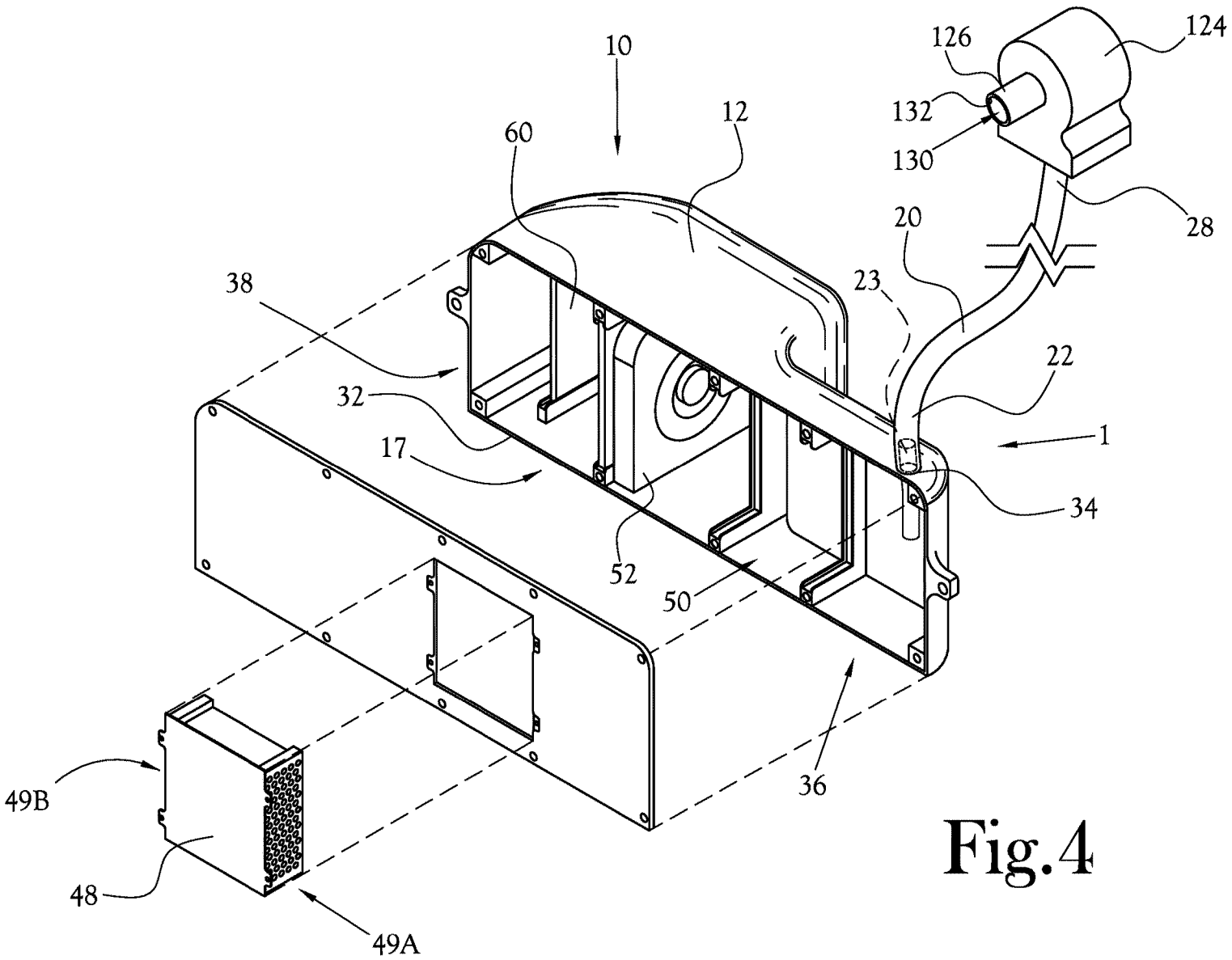
FIG. 4 illustrates an example embodiment of the present general inventive concept with the filter unit and rear panel of the housing exploded.
Figure 5:
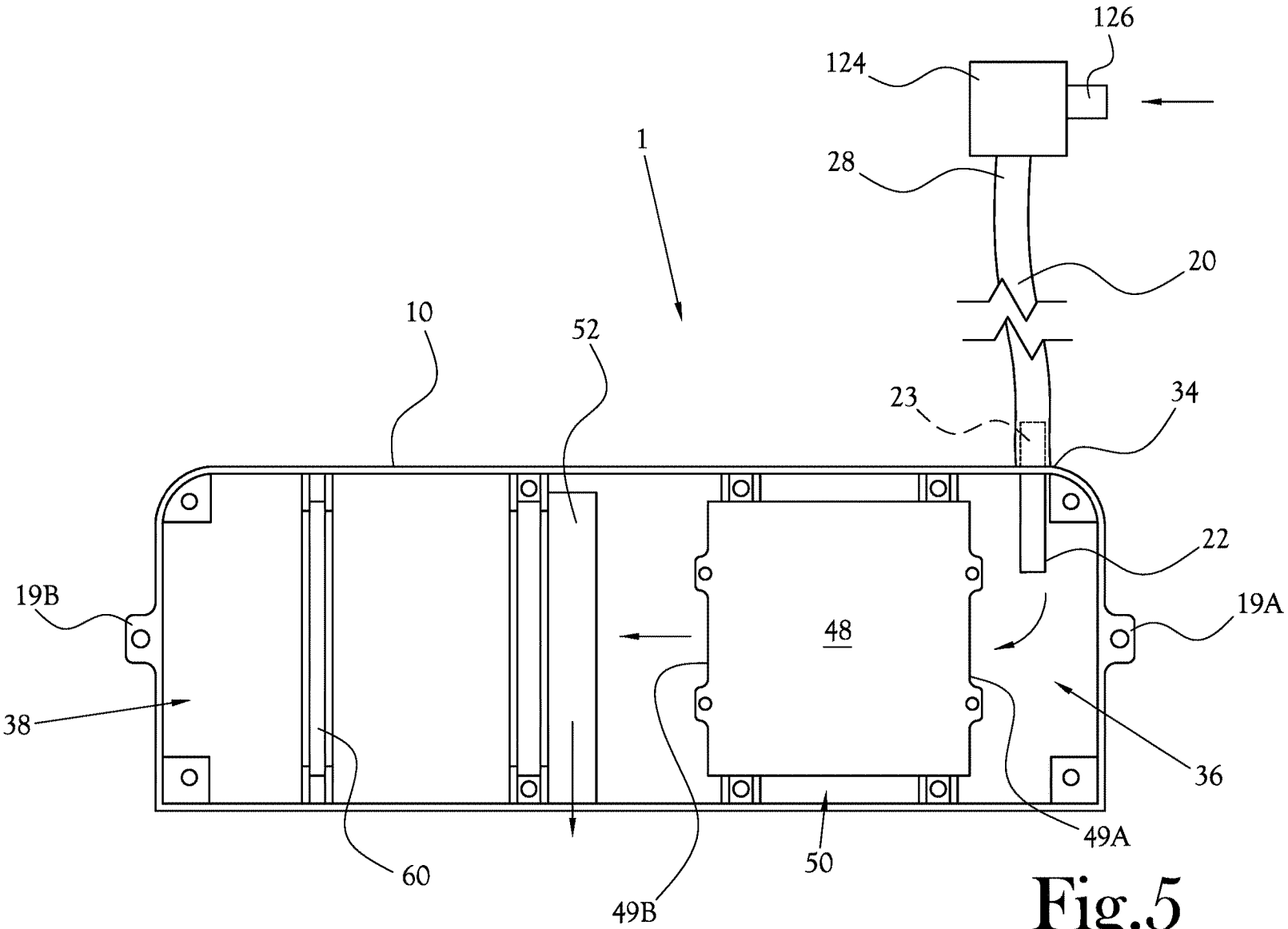
FIG. 5 illustrates an example embodiment of the present general inventive concept with direction arrows indicating the directional flow of the air passing through the air flow channel.
Figure 6:
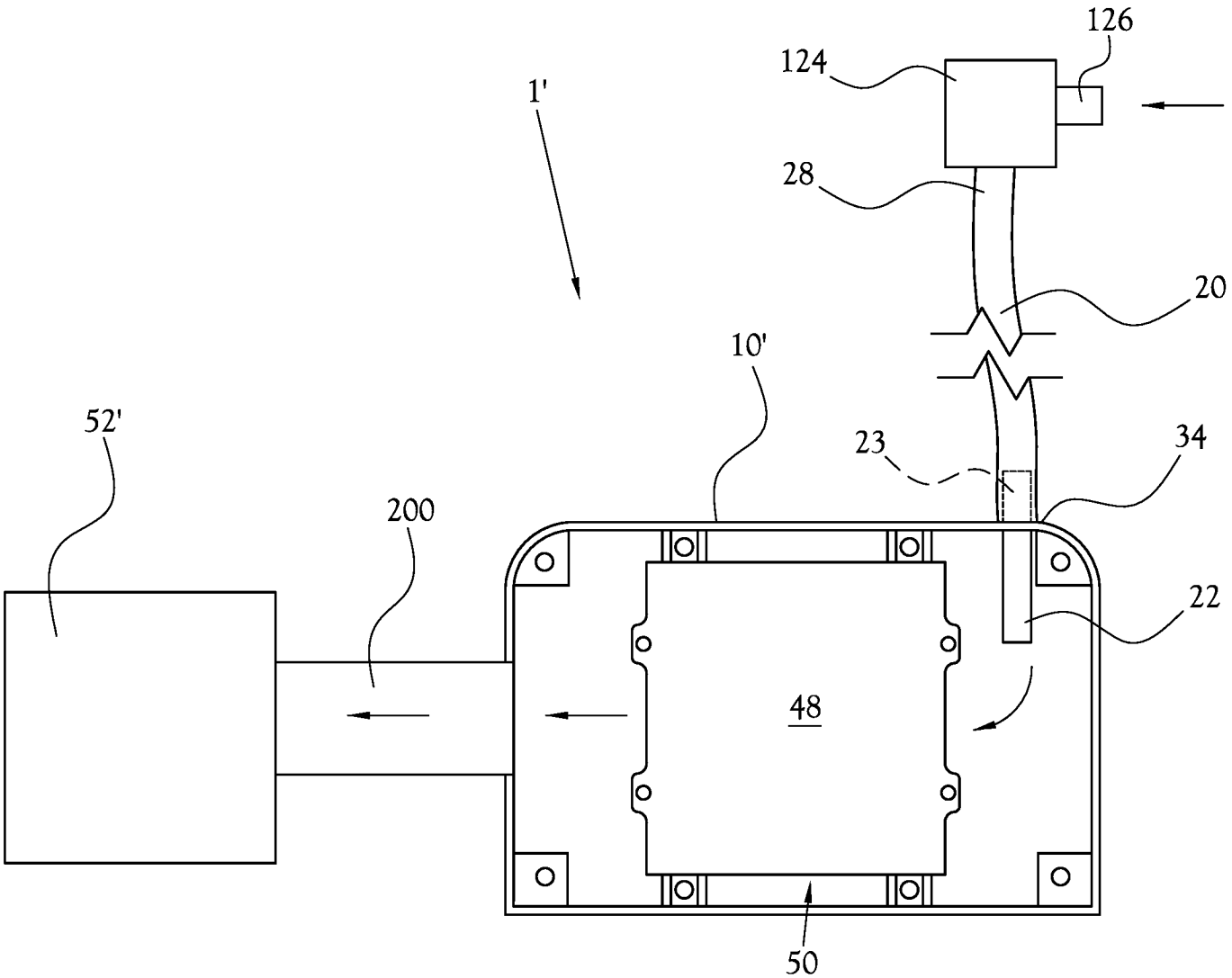
FIG. 6 illustrates an example embodiment of the present general inventive concept with the fan assembly removed from, yet still in fluid communication with, the housing.

Referring to FIGS. 4-5, a filter cartridge or unit 48 is selectively and removably secured within a filter receptacle that is part of the housing 10. The filter cartridge 48 conditions the air for re-introduction into the outside environment. A filtration media is located within filter cartridge 48. The filtration media is a material that, when disposed within filter cartridge 48, filters out odors, bacteria, and/or particulate matter when air passes through it. It will be understood that particulate matter includes visible particles as well as matter not visible to the naked eye such as miniscule matter and bacteria. In some embodiments, the filtration media is a substance that traps and kills bacteria. In the illustrated embodiment, the filtration media is charcoal. Other embodiments may contain filtration media other than charcoal, and it will be understood that the present general inventive concept is not limited by the specific type of filtration media. For instance, exemplary materials may be charcoal, activated charcoal, filter wool, filter wool made of polyethylene terephthalate or nylon, synthetic sponges or foams, ceramic or sintered glass, silicon products, activated carbon, Zeolite bio-ceramic balls, etc. Materials with a greater surface area may provide both mechanical and biological filtration.

Figure 9A:
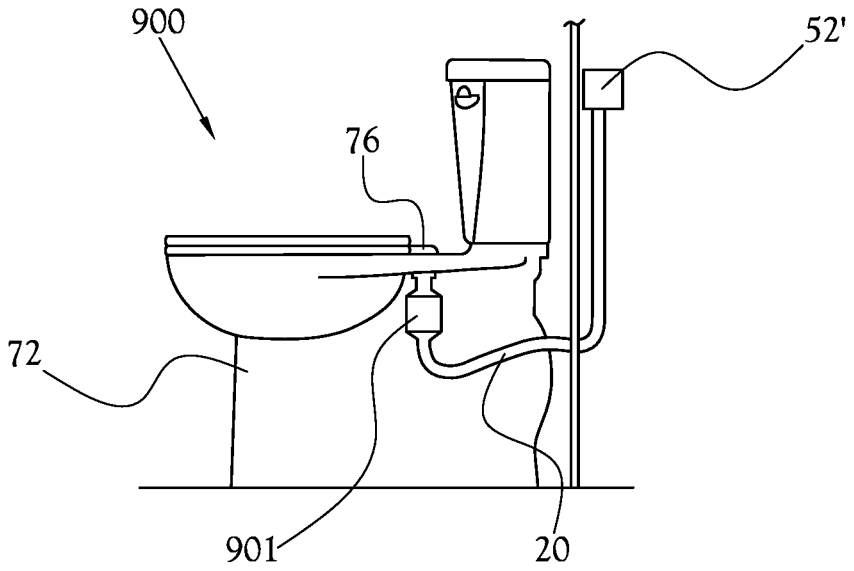
FIG. 9A illustrates a side view of an example embodiment toilet system.
Figure 9B:
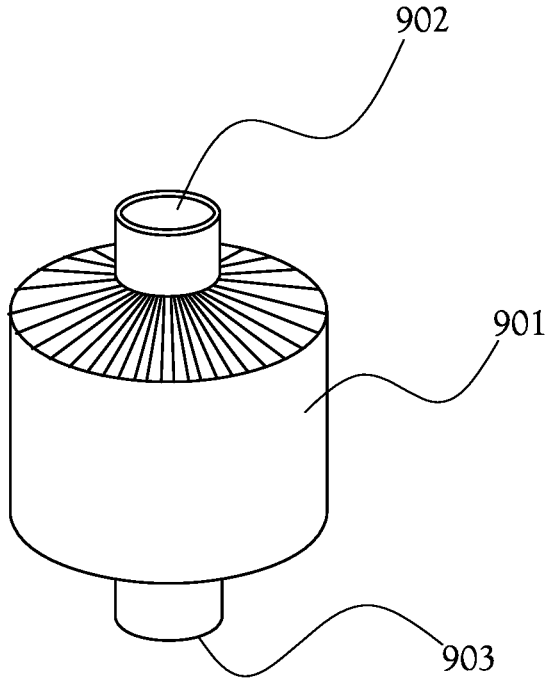
FIG. 9B illustrates an example embodiment filtration unit, as shown in FIG. 9A.
Figure 10:
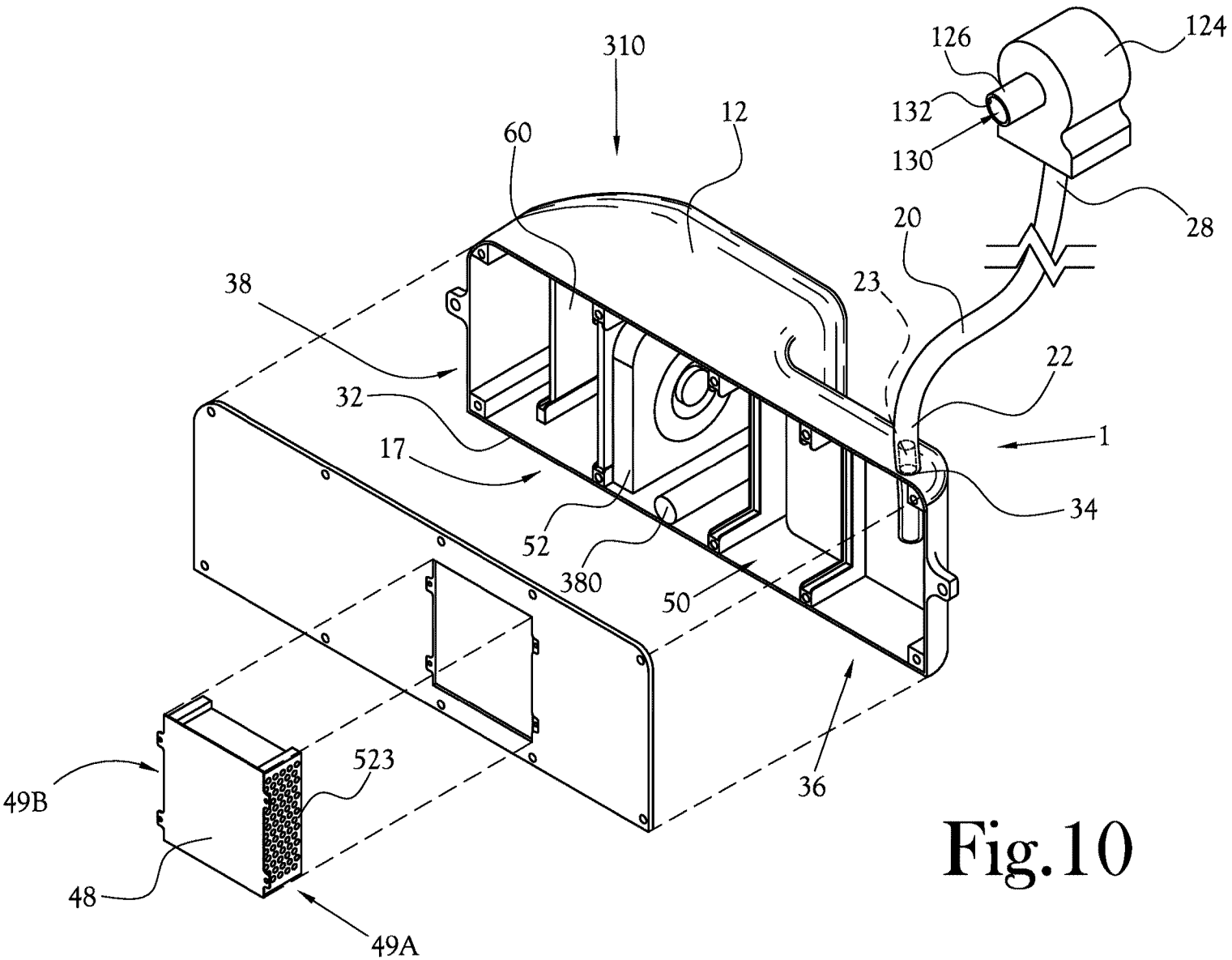
FIG. 10 illustrates an exploded perspective view of an embodiment of a toilet system.

Referring again to FIGS. 1-9 and further to FIG. 10, another embodiment contemplates a filter cartridge or unit 48 which may be selectively and removably secured within a filter receptacle that may be part of the housing 310. The filter cartridge 48 conditions the air for re-introduction into the outside environment. A filtration media 528 may be located within the filter cartridge 48. As described above, the filtration media may be a material that, when disposed within the filter cartridge 48, filters out and is a filter fine enough to prevent the passage of bacteria (e.g., around 0.5-5 μm in diameter), and/or viruses, odors, bacteria, and/or particulate matter when air passes through it. In some embodiments, the filtration media may be a substance that traps and kills bacteria, and is not limited by the specific type of filtration media. In some embodiments, a portion of the filter unit 48 may be selectively removable to provide access to the inner volume of the filter unit 48 such that the filtration media may be added or removed and replaced. The filtration unit 48 contains an inlet 49A and an outlet 49B. Inlet 49A and outlet 49B each contain a plurality of openings sized to allow air to freely pass while substantially containing the filtration media within the filter unit 48. The filter unit 48 may be mechanically disposed within the filter receptacle and may be selectively removed from the filter receptacle.

In some embodiments, a portion of the filter unit 48 is selectively removable to provide access to the inner volume of the filter unit 48 such that the filtration media may be added or removed and replaced. The filtration unit 48 contains an inlet 49A and an outlet 49B. Inlet 49A and outlet 49B each contain a plurality of openings sized to allow air to freely pass while substantially containing the filtration media within the filter unit 48. The filter unit 48 is mechanically disposed within the filter receptacle and may be selectively removed from the filter receptacle.

Figure 8:
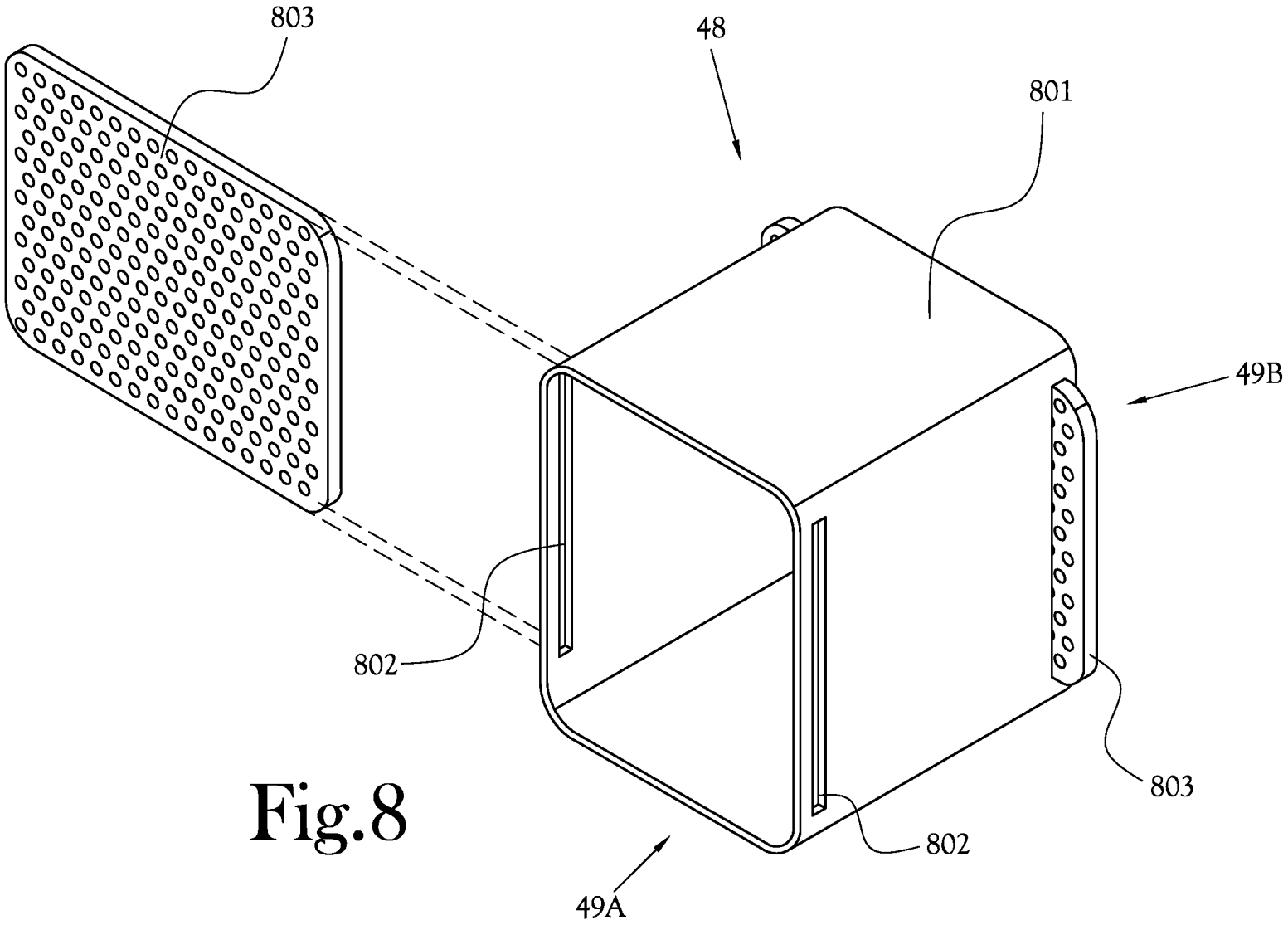
FIG. 8 illustrates an example embodiment of the filter cartridge included in the present general inventive concept.

Referring now to FIG. 8, an example filter cartridge in accordance with various embodiments of the present general inventive concept is shown. In some embodiments, a filter cartridge 48 is defined by a filter housing member 801, which may be produced, for example, by cutting a tube (conduit, cylinder, duct, pipe, etc.) to a preselected length; inserting slots 802 on opposing perimeter edges at both of the through openings; and sizing perforated screens 803 such that they may be slidably inserted into the slots 802 at the opposing perimeter edges of both through openings. The size of the perforations in the screens 803 may be any size as long as they allow for air to enter and exit the filter cartridge 48 while still substantially retaining filtration media there within. In the illustrated embodiment, the tube used to produce the filter housing member 801 is plastic with a substantially square cross section. One skilled in the art will understand that the specific material and cross-sectional shape of the tube may be substituted without departing from the scope or spirit of the present general inventive concept. In some embodiments, fasteners (not illustrated) are disposed in the perforated screens 803, immediately adjacent to the slotted, opposing perimeter edges, to secure the perforated screens 803 to the filter housing member 801. In some embodiments, the sides of the perforated screens 803 extend through the slots 802 of the filter housing member's opposing perimeter edges, and beyond the perimeter of the filter housing member 801. In accordance with this embodiment, the protruding screens 803 may engage with channels or grooves in the filter receptacle 50 to secure the filter cartridge 48 in the housing 10 (and/or 10').

Referring again to FIGS. 4 & 5, in order to maintain the position of the filter unit 48 within housing 10, a filter receptacle 50 is provided. In the illustrated embodiment, the filter receptacle 50 is defined by a space in the wall of the housing 10 that receives the filter cartridge 48 and allows the filter cartridge 48 to be selectively and mechanically attached to the housing 10. In some embodiments, the filter cartridge 48 is selectively secured within the filter receptacle 50 by at least one fastener (not illustrated). In other embodiments, channels or grooves may be provided on the filter receptacle to accommodate mating tongue members on the filter unit, or vice versa, to slidably mount the filter cartridge to the filter receptacle. When the filter receptacle 50 receives the filter cartridge 48, a portion of the filter cartridge 48 is biased against the inner surface of the housing 10 such that when the fan assembly 52 is activated, substantially all of the moved air is directed through the filter cartridge 48. The filter receptacle 50 is dimensioned to minimize obstruction in the air flow and is positioned to provide adequate support to inhibit the filter cartridge 48 from being pushed in either direction out of the airflow, while also accommodating easy removal and replacement thereof.

In the illustrated embodiments, the filter cartridge 48 (with or without grooves) is provided independent of the housing 10. Stated differently, the filter cartridge 48 may be selectively removable from the filter receptacle 50 as a single entity using, for example, a tongue-and-groove assembly. In other embodiments, the filter unit is comprised of the front 12 and rear 14 panels of the housing 10, along with perforated inlet and outlet panels that are selectively and mechanically disposed within the filter receptacle 50. That is, the filter unit 48 may be selectively removable from the filter receptacle 50 as a plurality of entities.

In some embodiments, a fan assembly 52 is provided within the housing 10 to draw air from within the toilet 72, through the conduit 20 to the interior volume 17 of the housing 10, and through the air flow channel, and the filter unit 48. After being filtered, fan assembly 52 reintroduces the filtered air into the room environment through an exhaust port or outlet (see, e.g., FIG. 14B at 1935) defined in the bottom panel 32. In the embodiment illustrated in FIGS. 4-5, the fan assembly 52 interposes the inlet and exhaust ports of the housing 10, and more particularly, the fan assembly 52 interposes the filter receptacle 50 and the exhaust port of the housing 10.

In other embodiments the fan assembly 52' may be located outside the housing 10' where the fan assembly 52' may be substantially similar to a central vacuum system or other similar, centrally located device for drawing air from a space. In that instance, the filtration system 1' may further define a fan receptacle 200 in fluid communication with the fan assembly 52' and selectively connectable to the air flow channel in order to facilitate a fluid communication between the fan assembly 52' and the air flow channel. In some embodiments, a pre-existing fan assembly 52', such as a ceiling fan or exhaust system, is put in fluid communication with the air flow channel, via a fan receptacle 200, to draw air from the toilet bowl 72, through the conduit 20, and through the filter cartridge 48.

Figure 7:
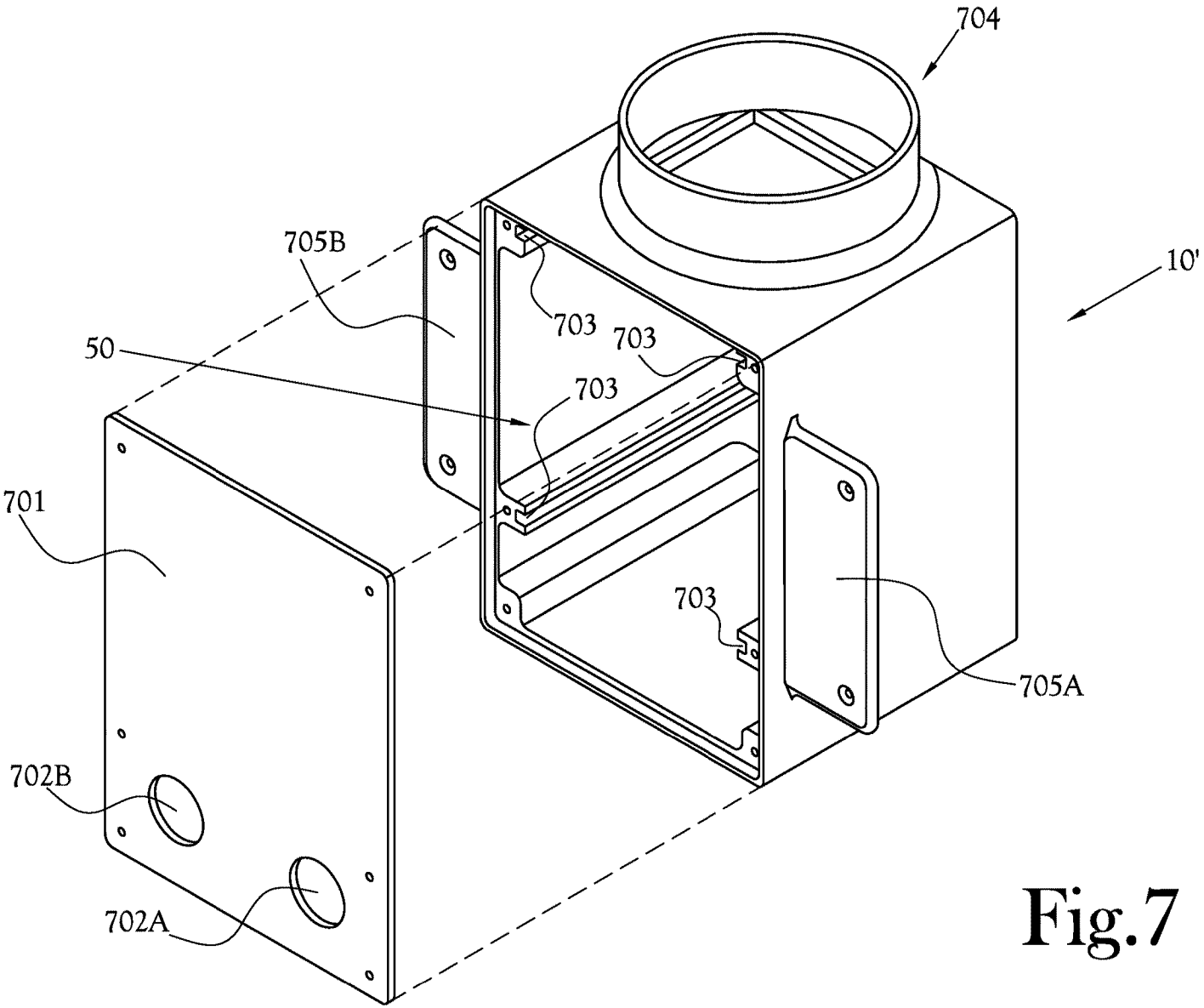
FIG. 7 illustrates an example embodiment of the housing included in the present general inventive concept for accommodating a fan assembly removed from, yet still in fluid communication with, the housing.

FIG. 7 illustrates an exemplary embodiment housing 10' that accommodates a fan assembly 52' located outside of the housing 10'. Housing 10' includes an access panel 701 for accessing the contents of the housing 10' and for engaging one or more conduits 20 in fluid communication with the air flow channel. As illustrated, access panel 701 includes two conduit receptacles 702A & 702B that engage the one or more conduits 20 extending from the ventilated toilet seat 76. Further included in the interior of the housing 10', is a filter receptacle 50 defined by installation grooves 703 for slidably installing a filter cartridge 48, as in FIG. 8. In the illustrated embodiment, the filter cartridge 48 is slidably installed in the filter receptacle 50 such that the filter cartridge 48 is biased against the sides of the housing 10' so that when the fan assembly 52' is activated, substantially all of the moving air passes through the filter cartridge 48. One skilled in the art will understand that the general present inventive concept is not limited to a filter cartridge 48 being secured within the filter receptacle by grooves 803. On the contrary, pins, screws, and other fasteners may also be used without deviating from the scope or spirit of the present general inventive concept. A friction seal or sealing material may be used regardless of the securing method to ensure a sealed housing. The interior of the housing 10' and/or exterior of the filter cartridge 48 may also be lined with a sealing material, such as foam, to ensure that substantially all moving air passes through the filter cartridge 48. The illustrated example embodiment housing 10' also includes a fan receptacle receiver 704 to receive a fan receptacle 200 in fluid communication with a fan assembly 52'. Installation panels 705A & 705B are also included on the illustrated embodiment to facilitate installation on a wall or like structure. Conventional fasteners may be used to secure the installation panels 705A & 705B against the wall. Other methods may be utilized to secure the structures provided herein.

FIG. 9A illustrates an example embodiment filtration system 900 that includes one or more filtration housing units in fluid communication with a toilet bowl and a fan assembly. In the illustrated embodiment, the fan assembly 52' is located outside of the filtration housing unit 901 and placed in fluid communication with it by the fan receptacle 20. FIG. 9B illustrates an example embodiment filtration housing unit 901 that is included in the example embodiment filtration system 900 in FIG. 9A. Filtration unit 901 includes a filtration media interposing an inlet 902 and an outlet 903. When the filtration system is activated, air and particulate matter are received from the ventilated toilet seat 76 into the filter unit's inlet 902, through the filtration media, out the filtration outlet 903, into the conduit 20, where the air is drawn towards the fan assembly 52' and eventually exhausted outside the air flow channel. In one embodiment, the filtration unit 901 includes two inlets 902 in instances where the ventilated toilet seat 76 includes two evacuation channels. In an alternative embodiment where the ventilated toilet seat 76 includes two evacuation channels, the filtration system includes two filtration units 901, each of which may be used independently, or in conjunction with the other. It will be understood that the present general inventive concept may include a plurality of filtration units, as determined by sound engineering judgment.

Referring again to FIGS. 4 & 5, the fan assembly 52 is selectively actuated by a controller 60. In some embodiments, the controller 60 is disposed within the housing 10. For example, in the embodiment illustrated in FIG. 4, the controller 60 is disposed within housing 10, adjacent to the fan assembly 52, distal the filter receptacle 50. In other embodiments, the controller 60 is disposed outside of the housing 10 (or 10', as in FIGS. 6, 7, & 9). It will be understood that the present general inventive concept is not intended to be limited by the specific location of the controller 60.

The controller 60 receives power from a power source and selectively directs power to the fan assembly 52 and/or 52'. For example, power may be provided from an external source through the use of a power cord. In other embodiments, power is provided internally with respect to the controller 60 such as, for example, with a battery. However, it will be understood that a variety of known or later developed means for powering the controller 60 and the fan assembly 52 and/or 52' may be effectively incorporated as well, such as, for example, solar power.

The controller 60 is configured to selectively activate and deactivate the fan assembly 52 and/or 52' for drawing contaminated air through the air flow channel according to various selection criteria. For example, an activation switch may communicate with the controller 60 to initiate or cease operation of the fan assembly 52 and/or 52' according to predetermined conditions. The activation switch may be located on or in the housing unit 10 or 10' or may be located externally, such as, for example, on a remote control. Alternatively, there may be an external condition activation switch whereby an external condition, for example, turning on or off a light switch, causes the activation switch to communicate with the controller 60 and initiate or cease operation of the fan assembly 52 and/or 52'. In some embodiments the external condition activation switch is influenced by a light sensor that selectively communicates to the controller 60 to initiate operation of the fan assembly 52 and/or 52' when the room environment is lit and subsequently deactivate the operation when the room environment is dark. In other embodiments, the external condition activation switch may be influenced by a pressure sensor proximate the ventilated toilet seat 76. In yet other embodiments, the external condition activation switch may be influenced by a motion sensor proximate the ventilated toilet seat 76, to activate and/or deactivate the fan assembly 52 and/or 52' according to a signal of the sensor.

In the illustrated embodiment of FIGS. 4-5, in order to provide access to the fan assembly 52, the rear panel 14 of the housing unit 10 is selectively removable. At least one removable fastener may be provided for securing the back panel to the remainder of the housing 10. Also, in order to provide further access to the fan assembly 52 and controller 60, a selectively attachable access panel (not illustrated) may be defined within the bottom panel 32. The access panel may be mechanically attachable to the bottom panel 32. It will be understood that other means of access to the interior volume 17 of the housing 10 may be provided as well.

A filter cartridge comprising an interior volume to receive filtration media, an inlet, and an outlet, may be located within the housing unit. The filter cartridge is secured within the filter receptacle, and the inlet and the outlet each define a plurality of openings sized to permit air containing odors and particulate matter to enter and exit the filter cartridge interior while substantially preventing the filtration media from exiting the filter cartridge interior. A filtration media may be contained within the filter cartridge interior volume to collect odors and particulate matter and trapping and killing bacteria when the air passes through the filtration media. In one embodiment, the filter cartridge is selectively secured within the filter receptacle by a fastener.

A fan assembly may be placed in fluid communication with the toilet bowl, further defining the air flow channel. When activated, the fan assembly draws air from the toilet bowl through the intake portion of the toilet seat hinge, through the exhaust portion of the toilet seat hinge, though the conduit into the housing, the fan assembly moving the air in the air flow channel into the filter cartridge inlet, through the filtration media, and out of the filter cartridge outlet, the fan assembly exhausting filtered air from the filtration system. In some embodiments, the system includes a plurality of filtration units.

In one embodiment, the fan assembly is located within the housing unit. In another embodiment, the fan assembly is in fluid communication with the air flow channel but is located outside of the housing downstream from the filter stage and includes a fan receptacle to place the fan assembly in fluid communication with the air flow channel.

A decontaminator 580, which includes an emitter 380 may be provided in the filter receptacle. Emitter 380 is utilized, in an exemplary embodiment, to transmit ultraviolet germicidal irradiation (UVGI). UVGI may be a disinfection method that uses ultraviolet (UV) light at sufficiently short wavelength to kill microorganisms. UVGI utilizes short-wavelength ultraviolet radiation (UV-C) that may be harmful to microorganisms and may be effective in destroying the nucleic acids in these organisms so that their DNA may be disrupted by the UV radiation, leaving them unable to perform vital cellular functions. Using a UVGI device in certain environments like circulating air or water systems creates a deadly effect on micro-organisms such as pathogens, viruses and molds that are present. UVGI may be coupled with a filtration system to remove harmful micro-organisms from certain environments. Ultraviolet light is electromagnetic radiation with wavelengths shorter than visible light. Decontaminator 580 may be any of a number of devices utilized to kill microorganisms (bacteria, germs, viruses, etc.), such as UV light, RF energy, ionizing radiation, toxic chemical emissions, high voltage energy germicide, etc. Decontaminator 580 may be located or disposed between the fan assembly and the exhaust side of the filter unit in a controller housing, fan housing or filter housing or other position or location. Emitter 380 may be one or more electroluminescence devices such as light emitting diode(s) (LEDs), an LED array, incandescent devices, gas filled devices, bulbs, tubes, etc.

Decontaminator 580 may be utilized to eliminate contaminants in the air flow such that the contaminants may not pass through the filter, which may extend the life of the filter between cleaning or replacement. Further, a decontaminator, such as decontaminator 580, may be provided between the filter unit 510 and the exhaust port of housing 512. To this end, an embodiment may have a decontaminator outside the filter assembly. The decontaminator may be on the inlet side of the filtration unit, the outlet side of the filtration unit, both sides of the filtration unit, outside the filter assembly, or a combination of all of these embodiments.

Figure 11A:
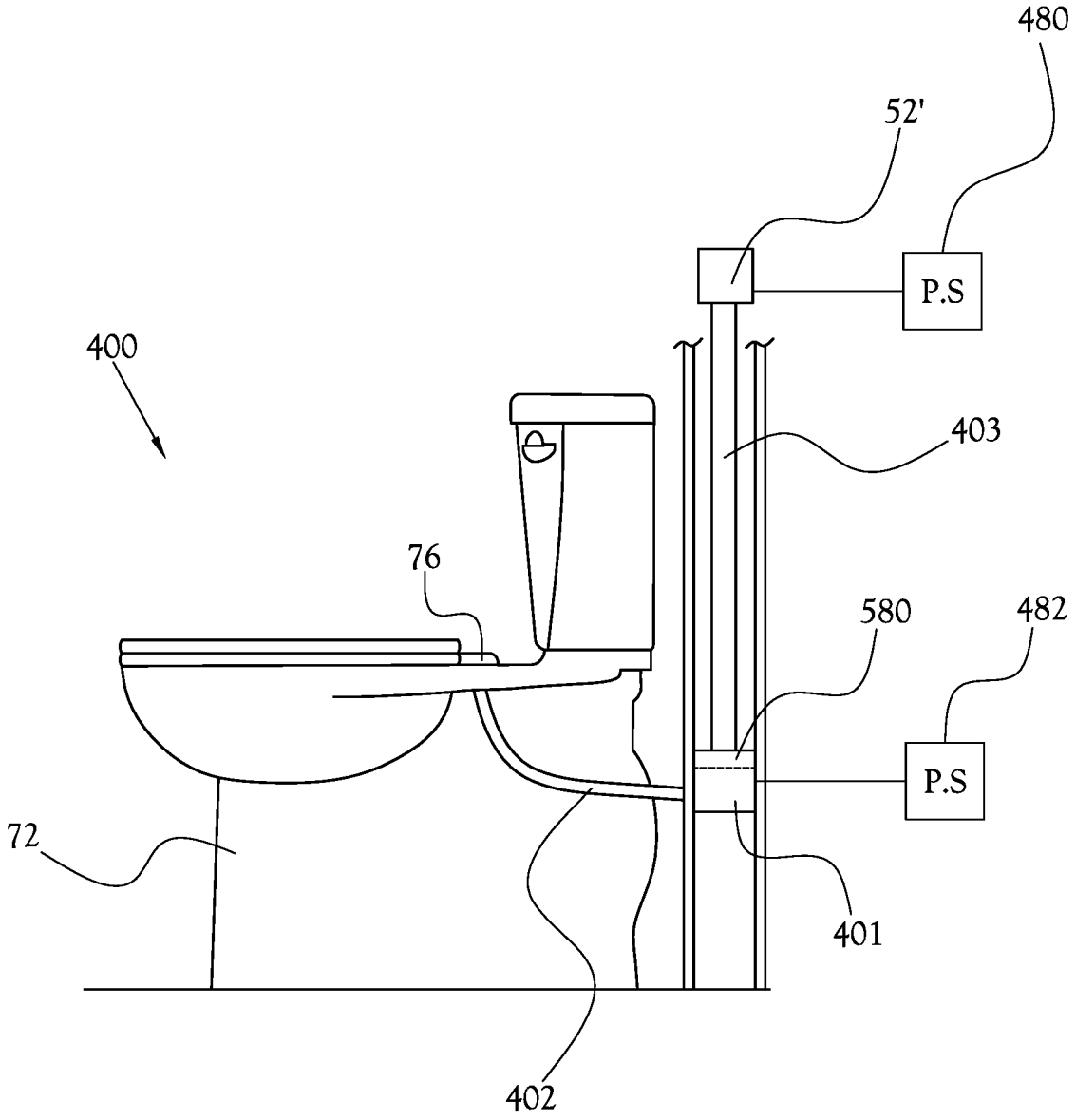
FIG. 11A illustrates a side view, partially cut away of an embodiment of a toilet system.
Figure 11B:
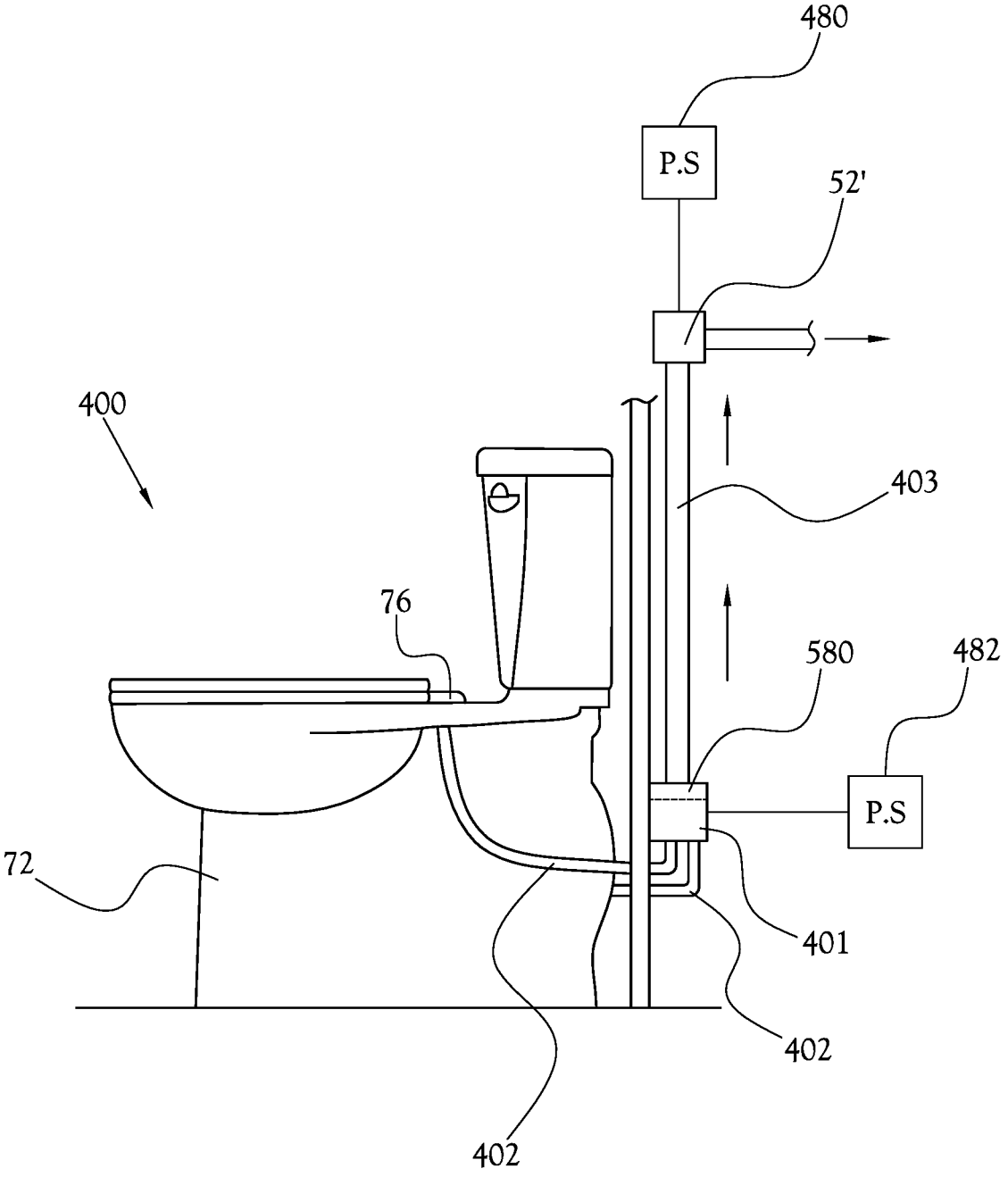
FIG. 11B illustrates a side view, partially cut away of an embodiment of a toilet system.
Figure 12:
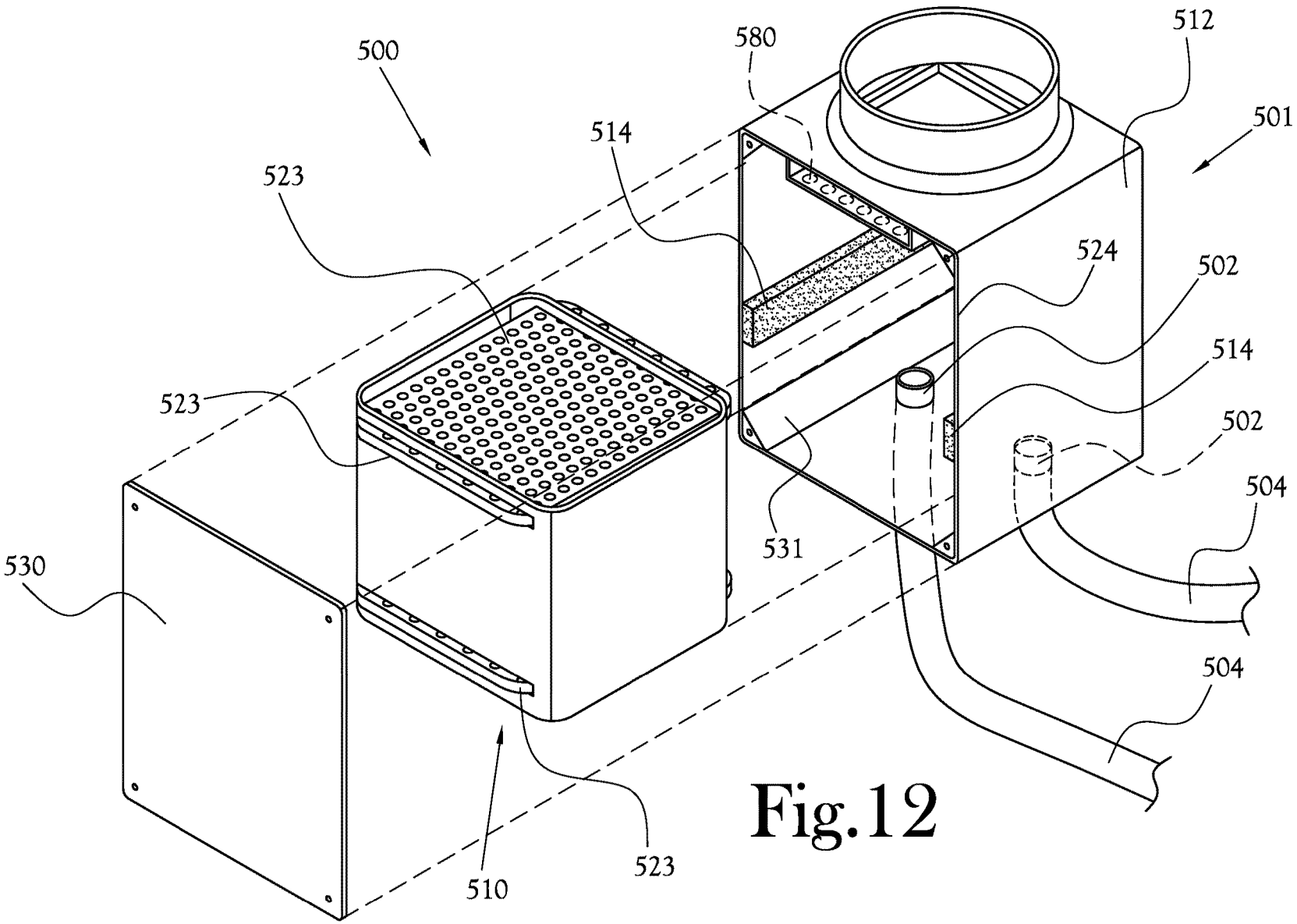
FIG. 12 illustrates an exploded perspective view of an embodiment of a toilet system.

Referring to FIGS. 11A and 11B, another embodiment 400 contemplates a filtration unit 401 which includes a filtration media interposing an inlet member 402 and an outlet 403. When the filtration system is activated, air and particulate matter are received from the ventilated toilet seat 76 into the filter unit's inlet 402, through the filtration media, out the filtration outlet 403 (which may be conduit), where the air is drawn or pulled towards the fan assembly 52' and eventually exhausted outside the air flow channel. As discussed above, a decontaminator, such as decontaminator 580 may be provided.

In an example embodiment of FIG. 11B, the filtration unit and/or the fan assembly are disposed behind a plumbing wall located behind one or more toilets disposed at the plumbing wall. Those skilled in the art will appreciate that various other configurations could be used to mount the devices. For example, the devices could be mounted on or behind a wall, beneath or above the floor, above or below the ceiling, etc.

Referring to FIGS. 1-12, an embodiment 500 contemplates a filtration assembly 501 which may include two access inlets 502 in instances where a ventilated toilet seat includes two evacuation channels 504. A filtration unit 510 may be sealed or seated into a housing 512 utilizing pliant seals 514 or sealing made from a material that is capable of being shaped, formed or molded and does not break apart when flexed. Pliant (compliant, pliable, malleable, ductile, transformable, flexible, etc.) sealing may be comprised of a number of materials, such as natural or synthetic plastics, rubbers, foam, plastic foams, elastomers, glass, corrugated cardboard, or paper products and the like suitable for sealing the filter unit and may create a seal between the filter unit and the housing to prevent air or other fluids from flowing around or bypassing the filter unit.

Filtration unit 512 deforms the seal 514 when the unit is inserted into the housing 512 such that the seal forms a seal around the unit to prevent air or other fluid from flowing between the housing and unit and in particular filters, thereby forcing the air through the filter to ensure proper operation of the filtration assembly 501. Filtration unit may include at least one additional seal 524 to further complement the seal 514 to prevent airflow around the filter. Seal(s) 524 may seal against a cover 530.

To this end, the inside of the housing cover 530 may have sealing material similar to that provided in the housing interior. In an embodiment, filtration unit 510 may sit or seat on bracket 531, such as angled brackets provided in the housing. In an embodiment, a sealing material such as foam may cover a substantial portion of the inside of the filter housing excluding areas which would impede the flow of air through the filtration unit. In an embodiment, the inside of the housing may comprise a reflective surface such that the output of emitter 380 is reflected off of various reflective surfaces to improve the efficiency of the decontaminator in destroying or killing microorganisms.

Figure 13:
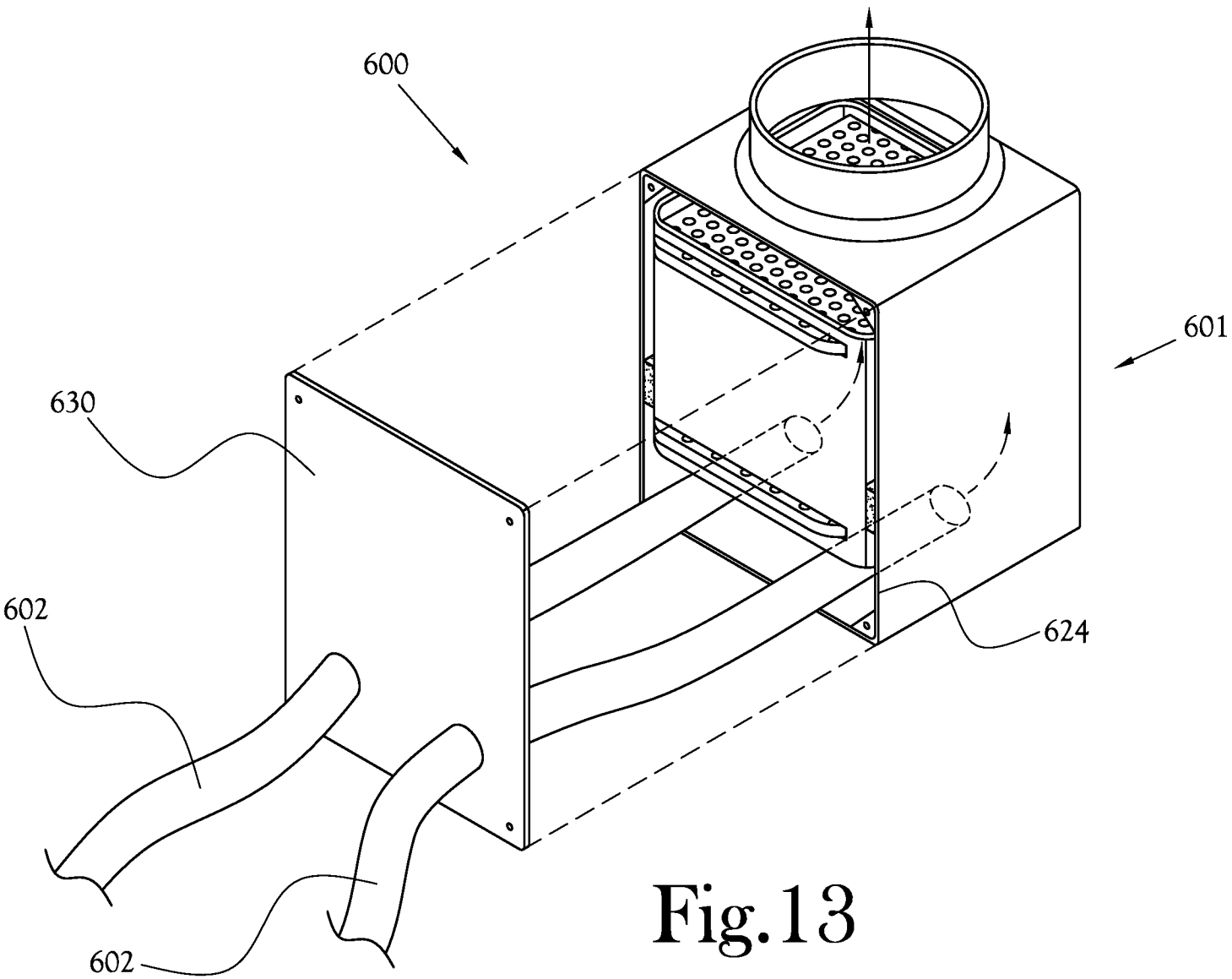
FIG. 13 illustrates an exploded perspective view of an embodiment of a toilet system.

In an embodiment, power may be provided to both the decontaminator(s) and fan(s) by one or more power supplies 480 and 482 from a variety of locations, the particular locations being selected as a function of construction convenience. The power supplies may provide low or high AC or DC voltage depending on the requirements of the fan(s) or decontaminator(s). Referring to FIG. 13, a further embodiment 600 contemplates a filtration assembly 601 which may include two access inlet tubes 602 in instances where a ventilated toilet seat includes two evacuation channels 504. The filtration unit may include at least one seal 624 to further complement a seal (not shown) to prevent airflow around the filter. Seal(s) 624 may seal against a cover 630. Access inlet tubes (hoses, channels, chutes, conduits, cylinders, duct, pipe etc.) may be routed or disposed through access holes or ports in a filter unit cover 630 and under the filter unit.

In some embodiments of the present general inventive concept, a filtration system to filter air from a toilet bowl includes a ventilated toilet seat pivotally coupled to the toilet bowl by a toilet seat hinge. In the exemplary embodiment, the toilet seat hinge 124 and manifold 112 interact to resistively hold the ventilated toilet seat 76 in an elevated position. As used herein, resistively hold refers to a still position achieved by a toilet seat after having been rotatably elevated with respect to a toilet bowl in such a manner as to substantially prevent the toilet seat 76 from rotating back down without an external force being applied.

A filtration system may also include a ventilated toilet seat coupled to the toilet bowl and having at least one resistance member disposed between the toilet seat hinge inlet portion and the hinge block to resistively inhibit the toilet seat from pivoting when the toilet seat is raised or lowered relative to the toilet bowl in a manner that does not allow the toilet seat to freely pivot when the toilet seat is lowered relative to the toilet bowl such that an external force is required to both raise and lower the toilet seat. In one exemplary embodiment, the resistance member is defined by at least one spring washer. However, it will be appreciated that the resistance member could be defined by other types of springs.

The toilet seat is held in a completely or partially elevated position by the compressive force provided by the spring washer. Referring to FIG. 3, the through opening 114 designed for receiving the inlet portion 126 of the toilet seat hinge 124 is, in an exemplary embodiment, cylindrical. A resistance member, such as a spring washer 230 is provided and registers with and is received by inlet portion 126 and is disposed between the inlet portion 126 and the hinge block of the toilet seat. The resistance member applies a compressive force between the inlet portion 126 and the hinge block of the toilet seat. This compressive force, such as one provided, for example, by tightening a fastener to provide a type of clamping action with the inlet portion 126 relative to the hinge block compresses the spring washer 230 and the compressed spring washer 230 provides resistance against rotation of the toilet seat to inhibit the toilet seat from falling abruptly. Alternatively, the compressive force of spring washer 230 is provided by the clearance between the inlet portion and the hinge block which serves to compress the spring washer. It is also possible to configure the resistance member to lock the toilet seat in a desired position, thus preventing rotation of the toilet seat relative to the toilet bowl absent the application of an external lifting or lowering force. FIGS. 3A, 3B, 3C, 3D, and 3E, illustrate exemplary configurations. As shown in the close-up view in FIGS. 3B and 3C, the toilet seat hinge block 124 includes sleeve 132 to engage with manifold 112 within and defined by the toilet seat 76, as well as an exhaust portion 134 in fluid communication with an air flow channel to deliver air from an underside of the ventilated toilet seat 76 to the air flow channel.

In the illustrated example embodiment, sleeve 132 is a cylindrical member that cooperates with a resistance member, such as spring washer 230 which registers with and is received by sleeve 132 and is disposed between sleeve 132 and manifold 112 to control rotational movement of the toilet seat. While one spring washer 230 could be disposed between manifold 112 and the hinge block of the toilet seat, in an exemplary embodiment, a plurality of spring washers 230 are utilized. For instance, as seen in FIGS. 3B and 3C, a plurality of spring washers 230 is stacked in series. In an alternate embodiment, illustrated in FIGS. 3D and 3E, a plurality of spring washers 230 is stacked in parallel. It will be appreciated that a flat washer shim, (not shown), could be disposed between two spring washers to adapt to the spacing between the manifold 112 and the hinge block 124. While the use of spring washers 230 has been described in conjunction with a ventilated toilet seat, it will be appreciated by those skilled in the art that inhibiting a non-ventilated toilet seat from falling abruptly is also beneficial. Accordingly, it will be appreciated that spring washers 230 could also be used with a non-ventilated toilet seat in order to provide resistance against rotation of the non-ventilated toilet seat to inhibit the toilet seat from falling abruptly.

Figure 14A:
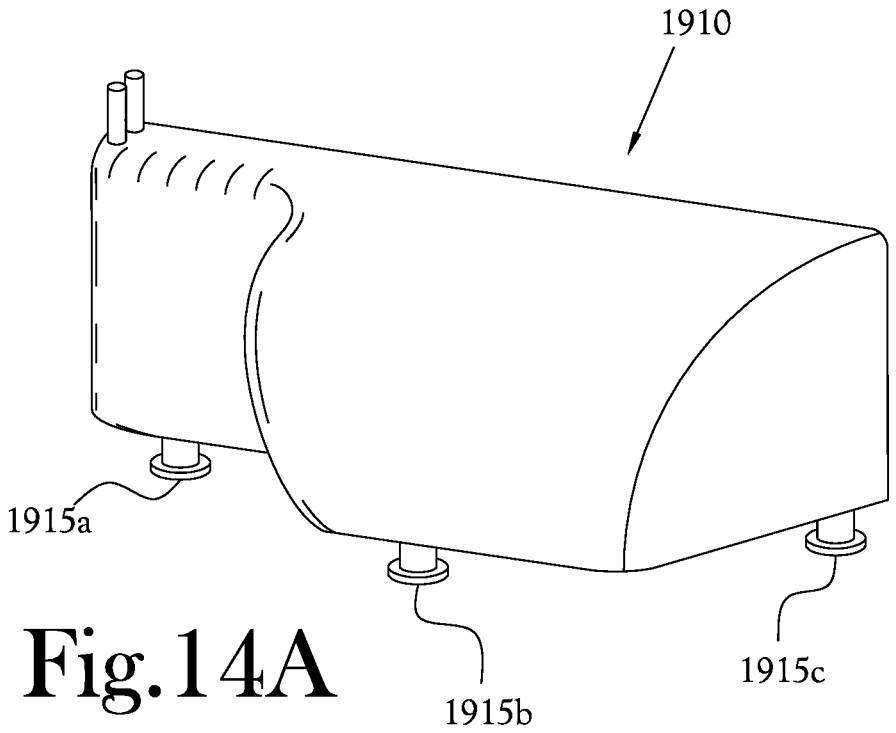
FIG. 14A is a perspective view of an example embodiment toilet system, the illustrated example embodiment includes a filtration system having bumpers or feet to elevate the filtration system housing above a floor or other mounting surface.
Figure 14B:
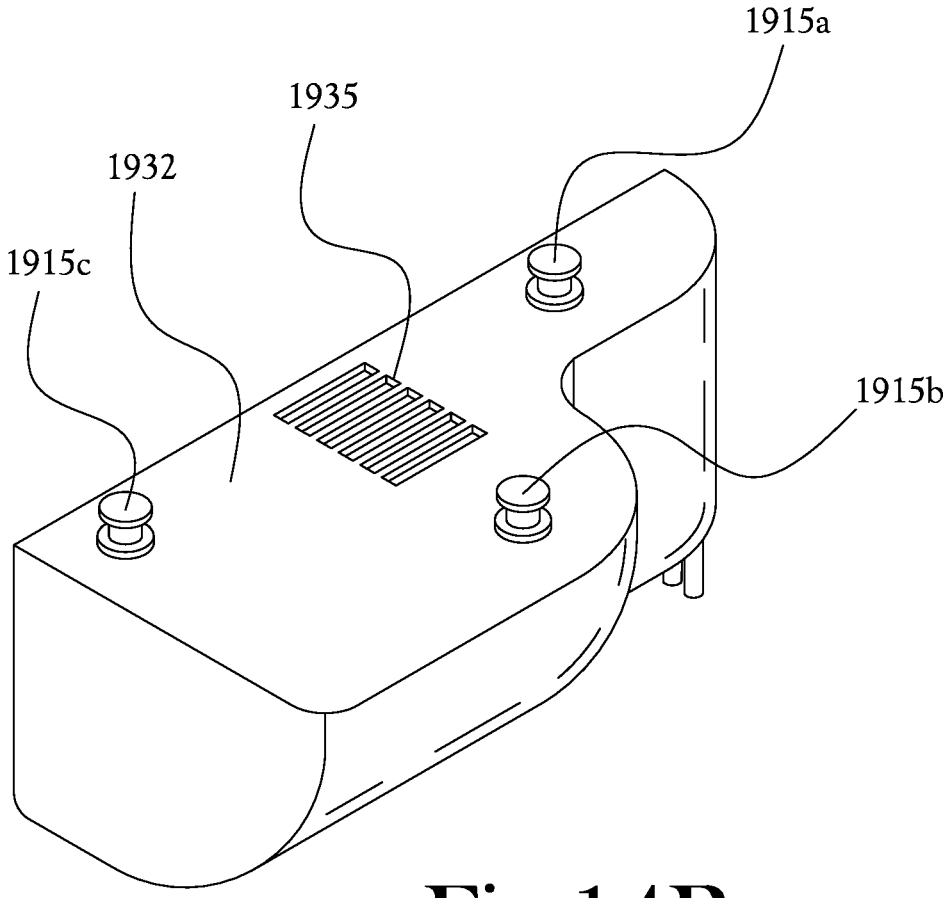
FIG. 14B is a second perspective view of the filtration system shown in FIG. 14A, showing the bottom panel of the filtration system housing.

In some embodiments of the present general inventive concept, a filtration system housing includes bumpers, legs, feet, or similar rising members (referred to herein as bumpers or feet) to elevate the filtration system housing above a floor or other mounting surface. FIGS. 14A and 14B illustrate one example embodiment of a filtration system housing 1910, which includes a number of feet 1915*a*, 1915*b*, 1915*c* affixed to or positioned on the lower panel 1932 of the filtration system housing 1910. In this example embodiment, the filtration system housing 1910 includes an exhaust port 1935 defined in the bottom panel 1932. In some embodiments, the feet 1915*a*, 1915*b*, 1915*c* can be dimensioned in shape and size to elevate the filtration system housing 1910 above the mounting surface sufficient to allow filtered air to exhaust through the exhaust port 1935 defined in the bottom panel 1932. Furthermore, the exhaust port 1935 and/or the feet can be designed and dimensioned in shape and size to facilitate a dampening effect on the exhausted air, thus muffling noise exhausted from the filtration system. Thus, in some embodiments, the feet that elevate the filtration system housing and/or the shape of the exhaust port can be designed for both optimizing airflow through the exhaust port and for acoustic muffling and/or dampening of noise generated by the filtration system. In some embodiments, the filtration system housing is elevated and/or the shape of the exhaust port is designed for baffling or for vibration reduction.

In FIG. 14B, the exhaust port 1935 and feet are defined in the bottom panel 1932 of the filtration system housing, but the present general inventive concept is not limited to this specific positioning of the feet and/or exhaust port. It is contemplated that the exhaust port and feet can each be positioned on the same or on different surfaces from one another without departing from the broader scope of the present general inventive concept. For example, it is possible to design the exhaust port in a side and/or top panel of the filtration system housing while locating the feet on the bottom panel, or other locations chosen with sound engineering judgement. In some embodiments, one or more exhaust ports can be defined in any of a number of panels of the filtration system housing. Those of skill in the art will recognize that a number of such arrangements are possible and that all of them are contemplated by and encompassed by the scope of the present general inventive concept.

The bumpers/feet affixed to or positioned on the filtration system housing thus facilitate the portability and variable usage of the filtration system. In particular, filtration system housings with feet may be used in situations where it is impractical or unadvisable to affix or mount a filtration system housing to a wall. Filtration system housings with feet are well adapted for use in apartments, for being positioned on a floor, or for being positioned on a table or work surface.

Although the illustrated example embodiment shows bumpers/feet affixed to or positioned on the filtration system housing in order to elevate the filtration system housing, the present general inventive concept is not limited to the use of bumpers/feet for this purpose. In various embodiments, numerous methods or means of raising the filtration system housing—e.g., a stand, risers, etc.—are useful for purposes of optimizing airflow, acoustic muffling, noise dampening, baffling, vibration reduction, and other related goals. Those of skill in the art will recognize that a number of such arrangements are possible and that all of them are contemplated by and encompassed by the scope of the present general inventive concept.

In some embodiments of the present general inventive concept, the filtration system housing can be configured to be mounted to a supporting surface such as a wall, floor, table, or other supporting surface of the toilet or container to which the filtration system is connected. For example, the filtration system housing can be configured to rest upon, or be supported by, the floor behind the toilet, or a wall, tabletop, or other structure proximate the toilet or other container. In some embodiments, the filtration system housing can be mounted to a wall or to another substantially vertical surface, such as the back of a toilet.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity may be repeated, any activity may be performed by multiple entities, and/or any element may be duplicated.

From the foregoing description, it will be recognized by those skilled in the art that a filtration system for use with a ventilated toilet seat assembly offering advantages over the prior art has been provided. In accordance with various embodiment of the present general inventive concept, a filtration system for removing odors, bacteria, and/or particulate matter from air from a toilet bowl may include an air flow channel partially defined by a housing unit having a filter receptacle located therein. The air flow channel may be further defined by a conduit comprising a proximal end and a distal end, the distal end secured adjacent to the toilet bowl, the proximal end in fluid communication with the housing. A connector may be selectively secured to the proximal end of the conduit, to mechanically secure the conduit to the housing in a substantially airtight engagement.

The filtration system may further include a toilet seat hinge to rotatably connect a toilet seat to the toilet bowl between an elevated and down position, the toilet seat hinge comprising an intake portion and an exhaust portion, the intake opening to the toilet bowl, the exhaust portion secured to the distal end of the conduit, a resistance member, such as a spring washer disposed between the intake member and the hinge block to resistively hold the toilet seat in the elevated position when the toilet seat is raised or lowered. The resistance member is adapted to prevent the toilet seat from being freely released when the toilet seat is lowered. In one embodiment, the intake portion comprises an inlet disposed on one end of the elliptical member. In one embodiment, the exhaust portion comprises an exhaust post having an exhaust disposed on a distal end thereof, the exhaust post securing a ventilated toilet seat to a toilet and receiving the distal end of the conduit.

Example embodiments of the present general inventive concept provide filtration systems to filter odor, bacteria, and/or particulate matter emanating from toilets.

Example embodiments of the present general inventive concept may be achieved by providing a filtration system to filter air from a toilet bowl including an air flow channel and fan assembly in fluid communication with a toilet bowl, a housing interposing the toilet bowl and the fan assembly, the housing having a filter receptacle to receive a filter unit therein, the filter unit being in fluid communication with the air flow channel, and a controller to selectively activate the fan assembly such that, when activated, the fan assembly draws air from the toilet bowl and through the filter unit to exhaust the air out of the air flow channel.

Example embodiments of the present general inventive concept may be also be achieved by providing a filtration system to filter air from a toilet bowl including a housing having an inlet port and an exhaust port and a filter receptacle interposing the inlet port and the exhaust port to receive a filter unit therein, a conduit having a first end and a second end, the first end securable adjacent to a toilet bowl, the second end connected to the inlet port, a fan assembly in fluid communication with the toilet bowl such that the filtration system defines an air flow channel to draw air from the toilet bowl through the conduit into the inlet port, through the filter unit, and through the exhaust port, and a controller to selectively activate the fan assembly.

Example embodiments of the present general inventive concept may further include a ventilated toilet seat pivotally coupled to the toilet bowl by a toilet seat hinge, the toilet seat hinge including an inlet portion to engage with the toilet seat and an exhaust portion in fluid communication with the air flow channel to deliver air from an underside of the ventilated toilet seat to the air flow channel.

A filtration system may also include a toilet seat that includes an intake to receive the toilet seat hinge, the intake in fluid communication with the toilet bowl, the hinge including an exhaust portion coupled to the conduit, whereby the fan assembly, when activated, draws air from the toilet bowl through the toilet seat hinge and into the air flow channel.

A filtration system may also include a received filter unit that is removably secured within the filter receptacle, and a filtration media contained within an interior volume of the filter unit, the filtration media to collect odors, bacteria and/or particulate matter when air passes through the filtration media. In some embodiments, the filtration media traps and kills bacteria that enter the filter unit.

In various example embodiments of the preset general inventive concept, the fan assembly is interposed between the inlet port and the exhaust port of the housing.

Example embodiments of the present general inventive concept may also be achieved by providing a fitting to the conduit and the housing.

In some embodiments, a fitting is provided having a first part coupled to the conduit and a second part coupled to the housing, the first part and second part cooperatively mating to secure the conduit to the housing in a substantially airtight engagement. In some embodiments, the fitting is a connector that is selectively coupled to the conduit, to the housing, or both.

Example embodiments of the present general inventive concept may be achieved by providing a filtration system including a filter unit having an inlet and an outlet such that air is drawn from the toilet bowl through the conduit, through the inlet port of the housing, into the filter unit inlet, through the filter unit outlet, and through the exhaust of the housing. In some embodiments, the filter unit inlet and outlet define a plurality of openings sized to permit air containing odors, bacteria, and/or particulate matter to enter and exit the filter unit's interior while substantially preventing the filtration media from exiting the filter unit's interior. In some embodiments, the filter unit includes a sealing material on an exterior surface thereof, and the housing includes a sealing material on an interior surface thereof to receive the filter unit in a manner such that substantially all moving air travels through the filter unit.

Example embodiments of the present general inventive concept may include a fan assembly located outside the housing and downstream from the filter and filter housing. In some embodiments, the air flow channel is further defined by a fan receptacle, the fan receptacle being selectively connectable to the housing and to the fan assembly. The fan assembly may be a preexisting fan assembly, such as a ceiling fan or exhaust system.

Example embodiments of the present general inventive concept may further include an activation switch communicating with the controller to selectively activate or deactivate the fan assembly. In some embodiments, the activation switch is located on or in the housing. The activation switch may be located on a remote control. The activation switch may be influenced by a light sensor, a motion sensor, and/or a pressure sensor.

In some embodiments, the filtration media traps and kills bacteria that enter the filter unit. Some embodiments further encompass a decontaminator for killing or eliminating particulate matter in the air flow. In some embodiments, the decontaminator includes an applicator for applying ultraviolet radiation to the air flow. In some embodiments, the decontaminator utilizes at least one of the following: UV light; RF energy; ionizing radiation; charcoal media; chemical emissions; high voltage energy and germicide. In some embodiments, the decontaminator utilizes at least one of the following: UV light; RF energy; ionizing radiation; chemical emissions; high voltage energy and germicide.

In some embodiments, the housing includes a bottom surface, and means are positioned on the bottom surface of the housing to elevate the housing above a surface when said housing is positioned on a surface. In some embodiments, the housing includes a bottom surface, and a number of feet are positioned on the bottom surface of the housing to elevate the housing above a surface when said housing is positioned on a surface. In some embodiments, the feet are sized to allow air flow from out of the air flow channel and to muffle sounds generated by air flow from out of the air flow channel.

In some embodiments, the housing includes a mounting surface to support the housing on a supporting surface, and the exhaust port is disposed on a side surface of the housing different than the mounting surface.

Some embodiments further include a filter unit that is removably secured within the filter receptacle and a filtration media contained within an interior volume of the filter unit, the filtration media to collect odors, bacteria, particulate matter, or any combination thereof when air passes through the filtration media.

In some embodiments, the housing includes a mounting surface and a means for separating the mounting surface from a supporting surface when the housing is mounted to or resting on the supporting surface.

In some embodiments, the mounting surface is a bottom surface and the means for separating the mounting surface from the supporting surface is a means for elevating the bottom surface relative to the supporting surface.

In some embodiments, the means for separating the mounting surface from the supporting surface include a plurality of feet positioned on the mounting surface configured to facilitate air flow from out of the air flow channel between the mounting surface and the supporting surface, and to muffle sounds generated by air flow from out of the air flow channel.

In some embodiments, the means for separating the mounting surface from the supporting surface is selected from a group consisting of adhesive members, removable adhesives, and suction cups.

Example embodiments of the present general inventive concept can also be achieved by providing a toilet seat hinge assembly for a toilet bowl, including a toilet seat configured with a hinge receptor proximate an axis about which toilet seat rotates when moving between open and closed states, a hinge block with a hinge member extending therefrom and configured to be received by the hinge receptor of the toilet seat so as to rotatably couple the toilet seat to the hinge block, a resistance member, such as, for example, at least one spring washer is received by the inlet portion of the hinge block such that the resistance member is disposed between the hinge block and the toilet seat. In this manner, the spring washer exerts pressure against the toilet seat and the hinge block and controls pivoting motion of the toilet seat relative to the toilet bowl requiring an external force to raise or lower the toilet seat.

While example embodiments of the present general inventive concept have been shown and described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the scope or spirit of applicant's general inventive concept.

What is claimed is:

1. A toilet system comprising:

a housing having an inlet port and an exhaust port, said housing including a filter receptacle having a guide member interposing said inlet port and said exhaust port to mate with a mating portion of a filter unit, the mating portion including one or more protrusions extending from opposing surfaces of the filter unit to mate with the filter receptacle, such that an inlet side of the filter unit is secured a predetermined distance away from the inlet port;

a conduit comprising a first end and a second end, said first end securable adjacent to a toilet bowl, said second end connected to said inlet port;

a fan assembly in fluid communication with said toilet bowl such that said filtration system defines an air flow channel to draw air from said toilet bowl through said conduit into said inlet port, through said filter unit, and through said exhaust port;

a toilet seat configured with a manifold proximate an axis about which toilet seat rotates when moving between open and closed states;

a hinge block with a sleeve extending therefrom and configured to be received by the manifold of the toilet seat so as to rotatably couple the toilet seat to the hinge block, wherein the ventilated toilet seat is pivotally coupled to the toilet bowl by the toilet seat hinge block, and wherein the sleeve to engage with the manifold of the toilet seat and an exhaust portion in fluid communication with the air flow channel to deliver air from an underside of the ventilated toilet seat to the air flow channel wherein the manifold receives said toilet seat hinge sleeve, and the manifold is in fluid communication with the toilet bowl, whereby said fan assembly, when activated, draws air from said toilet bowl through said manifold and the toilet seat hinge sleeve and into said air flow channel;

at least one resistance member disposed between the toilet seat manifold and the hinge block to resistively inhibit the toilet seat from pivoting when the toilet seat is raised or lowered relative to the toilet bowl; and a controller to selectively activate said fan assembly.

2. The toilet system of claim 1, further comprising:

a filter unit that is removably secured within the filter receptacle; and a filtration media contained within an interior volume of said filter unit, said filtration media to collect odors, bacteria, particulate matter, or any combination thereof when air passes through said filtration media.

3. The toilet system of claim 2, wherein said filtration media traps and kills bacteria that enter the filter unit.

4. The toilet system of claim 1, wherein said at least one resistance member is at least one spring washer.

5. The toilet system of claim 4, wherein a plurality of spring washers are stacked in series.

6. The toilet system of claim 4, wherein a plurality of spring washers are stacked in parallel.

7. The toilet system of claim 1, further comprising a fitting having a first part coupled to said conduit and a second part coupled to said housing, said first part and said second part cooperatively mating to secure said conduit to said housing in a substantially airtight engagement.

8. The toilet system of claim 1, wherein said received filter unit includes an inlet and an outlet such that air is drawn from the toilet bowl through said conduit, through said inlet port of said housing, into said filter unit inlet, through said filter unit outlet, and out said exhaust of said housing.

9. The toilet system of claim 8 wherein said received filter unit inlet and outlet define a plurality of openings sized to permit air containing odors and particulate matter to enter and exit said filter unit's interior while substantially preventing said filtration media from exiting said filter unit's interior.

10. The toilet system of claim 8, wherein said filter unit includes a sealing material on an exterior surface thereof, and said housing includes a sealing material on an interior surface thereof to receive said filter unit in a manner such that substantially all moving air travels through said filter unit.

11. The toilet system of claim 1, wherein said fan assembly is located downstream from said housing.

12. The toilet system of claim 1, wherein said air flow channel is further defined by a fan receptacle, said fan receptacle is selectively connectable to said housing and to said fan assembly.

13. The toilet system of claim 1, further comprising an activation switch, said activation switch communicating with said controller to selectively activate or deactivate said fan assembly.

14. The toilet system of claim 13, wherein said activation switch is located on or in said housing.

15. The toilet system of claim 14, wherein said activation switch is located on a remote control.

16. The toilet system of claim 14, wherein said activation switch is influenced by a light sensor, a motion sensor, a pressure sensor, or any combination thereof.

17. The toilet system of claim 1 wherein said sleeve is secured to said hinge block.

18. A toilet seat hinge assembly for a toilet bowl, comprising:

a toilet seat configured with a manifold proximate an axis about which toilet seat rotates when moving between open and closed states;

a hinge block with a sleeve extending therefrom and configured to be received by the manifold of the toilet seat so as to rotatably couple the toilet seat to the hinge block;

at least one resistance member disposed between the toilet seat hinge receptor and the hinge block to resistively inhibit the toilet seat from pivoting when the toilet seat is raised or lowered relative to the toilet bowl.

19. The toilet seat hinge assembly of claim 18, wherein said at least one resistance member is at least one spring washer.

20. The toilet seat hinge assembly of claim 18, wherein the toilet seat is configured to be ventilated, and the hinge block is configured to pass air from an underside of the ventilated toilet seat through the toilet seat hinge assembly.

* * * * *